US006312237B2

(12) United States Patent
Kouno et al.

(10) Patent No.: US 6,312,237 B2
(45) Date of Patent: Nov. 6, 2001

(54) DISPLACEMENT TYPE FLUID MACHINE

(75) Inventors: Takeshi Kouno; Hirokatsu Kohsokabe, both of Ibaraki-ken; Masahiro Takebayashi, Tochigi-ken; Shunichi Mitsuya, Hamamatsu; Shigetaro Tagawa; Yasuhiro Ohshima, both of Tochigi-ken; Kingo Moriyama, Shimizu, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/798,962

(22) Filed: Mar. 6, 2001

Related U.S. Application Data

(62) Division of application No. 09/270,684, filed on Mar. 16, 1999, now Pat. No. 6,220,841.

(30) Foreign Application Priority Data

Mar. 19, 1998 (JP) ..... 10-069783

(51) Int. Cl.[7] ..... F01C 1/04; F01C 21/04

(52) U.S. Cl. ..... 418/61.1; 418/76; 418/77; 418/94; 418/100

(58) Field of Search ..... 418/61.1, 76, 77, 418/94, 91, 100

(56) References Cited

U.S. PATENT DOCUMENTS

| | | | | |
|---|---|---|---|---|
| 336,144 | * | 2/1886 | Nash | 418/61.1 |
| 1,277,437 | * | 9/1918 | Lind | 418/61.1 |
| 2,112,890 | * | 4/1938 | Gunn | 418/94 |
| 6,152,714 | * | 11/2000 | Mitsuya et al. | 418/61.1 |
| 6,179,593 | * | 1/2001 | Mitsuya et al. | 418/61.1 |
| 6,213,743 | * | 4/2001 | Kohsokabe et al. | 418/61.1 |
| 6,217,303 | * | 4/2001 | Kohsokabe et al. | 418/61.1 |

FOREIGN PATENT DOCUMENTS

| | | | |
|---|---|---|---|
| 1026500 | 4/1953 | (FR) | 418/61.1 |
| 0023353 | 2/1980 | (JP) | 418/61.1 |
| 5202869 | 8/1993 | (JP) | 418/61.1 |
| 6280758 | 10/1994 | (JP) | 418/61.1 |
| 0259701 | 9/1998 | (JP) | 418/61.1 |
| 11050978 | 2/1999 | (JP) | 418/61.1 |
| 9408140 | 4/1994 | (WO) | 418/61.1 |

* cited by examiner

*Primary Examiner*—Thomas Denion
*Assistant Examiner*—Thai-Ba Trieu
(74) *Attorney, Agent, or Firm*—Antonelli, Terry, Stout & Kraus, LLP

(57) ABSTRACT

In a displacement type fluid machine wherein a space is formed by the inner wall surface of a cylinder and the outer wall surface of a displacer when the center of the cylinder is located on the center of the displacer, and a plurality of working chambers is formed when the positional relationship between the displacer and cylinder is for a gyration, the wear is reduced between the cylinder and displacer. Sliding portions between the displacer 5 and a cylinder 4 are fed with a lubricating oil 12 by forming an oil-feeding groove 5*c* in the surface of the displacer 5 so as to extend from the central portion of the displacer 5 to the vicinity of a suction port 7*a*, and feeding the lubricating oil 12 from the central portion of the displacer 5, so that the wear can be reduced.

2 Claims, 19 Drawing Sheets

0°

60°

120°

180°

240°

300°

0°

60°

120°

180°

240°

300°

0°

60°

120°

180°

240°

300°

DISPLACEMENT TYPE FLUID MACHINE

This is a divisional application of U.S. Ser. No. 09/270,684, filed Mar. 16, 1999, and U.S. Pat. No. 6,220,841, issued Apr. 24, 2001.

BACKGROUND OF THE INVENTION (i) Field of the Invention

The present invention relates to a displacement type fluid machine such as a pump, a compressor and an expander.

(ii) Description of the Related Art

As conventional displacement type fluid machines, there are known a reciprocating fluid machine wherein a working fluid is driven by the manner that a piston repeats a reciprocation in a cylindrical cylinder, a rotary (rolling piston type) fluid machine wherein a working fluid is driven by the manner that a cylindrical piston is eccentrically rotated in a cylindrical cylinder, and a scroll fluid machine wherein a working fluid is driven by the manner that a pair of fixed scroll and orbiting scroll which have spiral wraps and stand up on end plates are engaged with each other and the orbiting scroll is gyrated.

The reciprocating fluid machine has some advantages in easiness of manufacture and inexpensiveness because of its simple construction. On the other hand, because the stroke from suction completion to discharge completion is short as 180° of the shaft angle so as to increase the flow velocity in discharge process, the reciprocating fluid machine has a problem that its performance deteriorates due to an increase of the pressure loss. Besides, because it is necessary to reciprocate the piston, the rotating shaft system can not be completely balanced. This causes another problem of a great vibration and noise.

In the rotary fluid machine, because the stroke from suction completion to discharge completion is 360° in the rotational angle of a rotating shaft, such a problem as an increase of the pressure loss in discharge process is less severe than in the reciprocating fluid machine. But, because the working fluid is discharged once per shaft rotation, there is a relatively wide variation of the gas compression torque. This causes a similar problem of vibration and noise to that in the reciprocating fluid machine.

In the scroll fluid machine, because the stroke from suction completion to discharge completion is long as 360° or more in the rotational angle of the rotating shaft (usually about 900° in case of a scroll fluid machine practically used as an air conditioner), the pressure loss in discharge process is little. Besides, because there is formed a plurality of working chambers in general, the variation of the gas compression torque in one rotation is little. This causes less vibration and noise. The scroll fluid machine is therefore advantageous on the above points. In the scroll fluid machine, however, it is necessary to maintain the clearance between the spiral wraps in engagement and the clearance between the end plate and a wrap tip. For this purpose, working with a high accuracy is required. This causes a problem of expensiveness in working. Besides, because the stroke from suction completion to discharge completion is long as 360° or more in the rotational angle of the rotating shaft, there is a problem that the longer the period of compression process is, the more the internal leakage increases.

One kind of displacement type fluid machine wherein a displacer for displacing a working fluid does not rotates relatively to a cylinder having sucked the working fluid but revolves, namely, gyrates with a substantially fixed radius to carry the working fluid, is proposed in Japanese Patent Unexamined Publication No. 55-23353 (cited reference 1), U.S. Pat. No. 2,112,890 (cited reference 2), Japanese Patent Unexamined Publication No. 5-202869 (cited reference 3), and Japanese Patent Unexamined Publication No. 6-280758 (cited reference 4). Such a displacement type fluid machine as proposed therein comprises a petal-shaped displacer having a plurality of members (vanes) radially extending from the center of the displacer, and a cylinder having a hollow portion of substantially the same shape as the displacer. The displacer gyrates in the cylinder to displace a working fluid.

The displacement type fluid machine disclosed in the above cited-references 1 to 4 has the following advantageous characteristics. Because it has no reciprocating part unlike the reciprocating fluid machine, its rotating shaft system can be completely balanced. This brings about a little vibration. Besides, because the sliding velocity between the displacer and cylinder is low, it is possible to relatively reduce the friction loss.

In this displacement type fluid machine, however, because the stroke from suction completion to discharge completion in each of working chambers defined by the vanes of the displacer and the cylinder, is short as about 180° (210°) of the rotational angle $\theta c$ of the rotating shaft (almost a half of that of a rotary fluid machine and in the same extent of that of a reciprocating fluid machine), there is a problem that the flow velocity in discharge process increases and so the pressure loss increases to deteriorate the performance of the machine.

A displacement type fluid machine for solving the above problems is proposed in Japanese Patent Unexamined Publication No. 9-268987 (cited reference 5).

SUMMARY OF THE INVENTION

In the displacement type fluid machines described in the above cited-references 1 to 5, however, there has been found a new problem that the displacer and cylinder are worn away when the outer wall surface of the displacer slides on the inner wall surface of the cylinder.

It is an object of the present invention to provide a displacement type fluid machine comprising a displacer and a cylinder disposed between end plates such that a space is formed by the inner wall surface of the cylinder and the outer wall surface of the displacer when the center of the cylinder is located on the center of the displacer, and a plurality of working chambers is formed when the positional relationship between the displacer and cylinder is directed to a gyration position, wherein the wear of the displacer and cylinder can be reduced.

According to the present invention, the above object can be attained by a displacement type fluid machine comprising a displacer and a cylinder disposed between end plates such that a space is formed by the inner wall surface of the cylinder and the outer wall surface of the displacer when the center of the cylinder is located on the center of the displacer, and a plurality of working chambers is formed when the positional relationship between the displacer and cylinder is directed to a gyration position, a suction port for introducing a fluid into one of the working chambers, a discharge port for discharging the fluid from the one of the working chambers, and an oil-feeding system for feeding a lubricating oil to the outer wall surface on the suction port side of the displacer and the inner wall surface of the cylinder opposite to the outer wall surface.

According to the present invention, the above object can be also attained by a displacement type fluid machine comprising a cylinder having an inner wall whose contour in a cross section is formed by a continuous curve, a displacer having an outer wall opposite to the inner wall of the cylinder for forming a plurality of working chambers by the outer wall in cooperation with the inner wall when the positional relationship between the displacer and cylinder is directed to a gyration position, a suction port for introducing a fluid to one of the working chambers, a discharge port for discharging the fluid from the one of the working chambers, and an oil-feeding system for feeding a lubricating oil to the suction port.

The present invention as described above has an effect that the friction loss can be reduced because sliding portions of the outer wall surface of the tip portion on the suction port side of the displacer and the inner wall surface of the cylinder can be fed with a lubricating oil.

DETAILED DESCRIPTION OF THE PREFERRED EMBODIMENTS

Figure 1A:
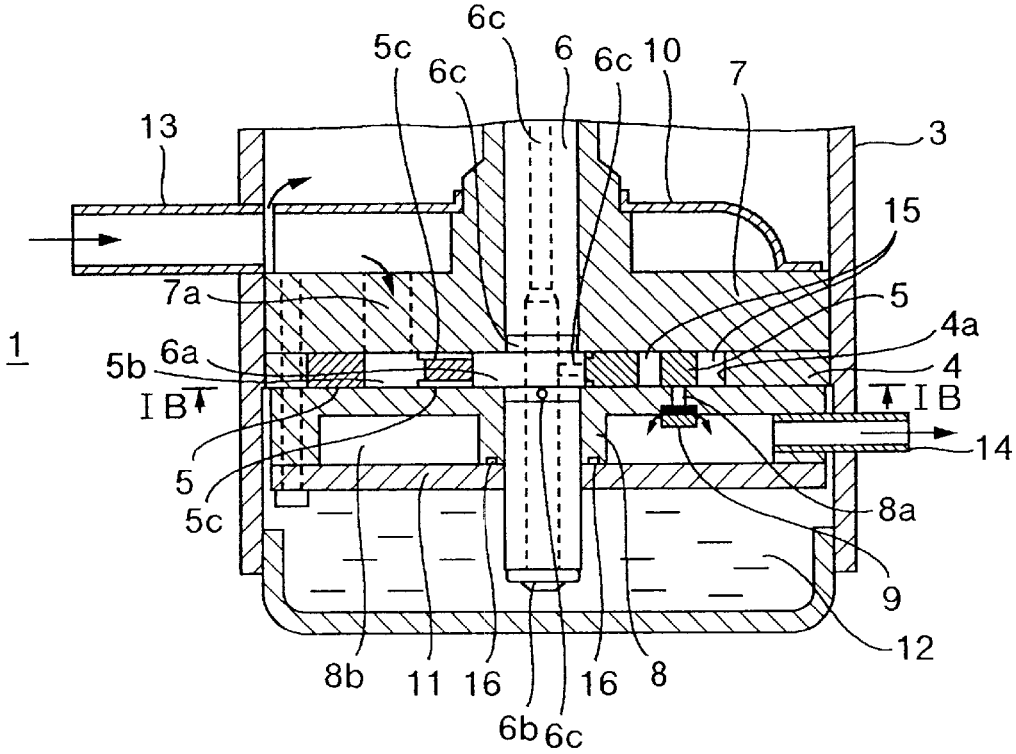
FIGS. 1A and 1B are a vertical sectional view and a plan view of a compression element of a hermetic type compressor wherein a displacement type fluid machine according to the present invention is applied to the compressor.
Figure 1B:
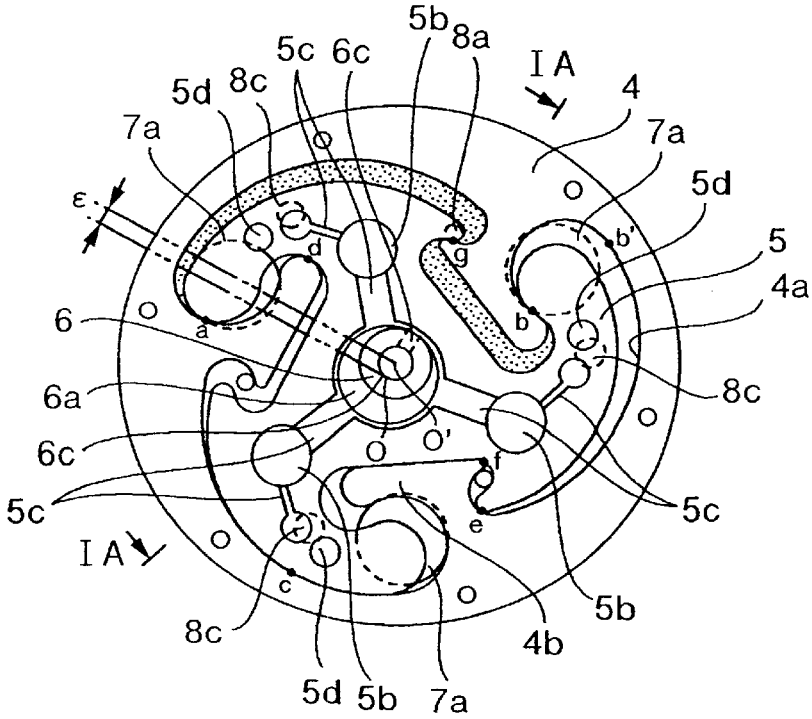
Figure 2A:
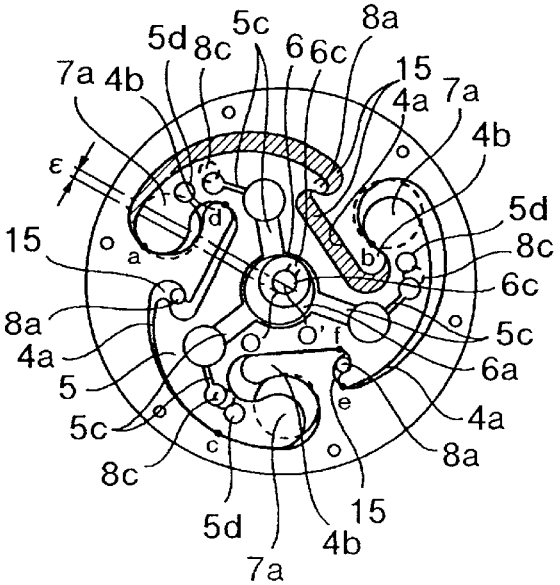
FIGS. 2A to 2D are views for illustrating the principle of operation of the displacement type fluid machine according to the present invention.
Figure 2B:
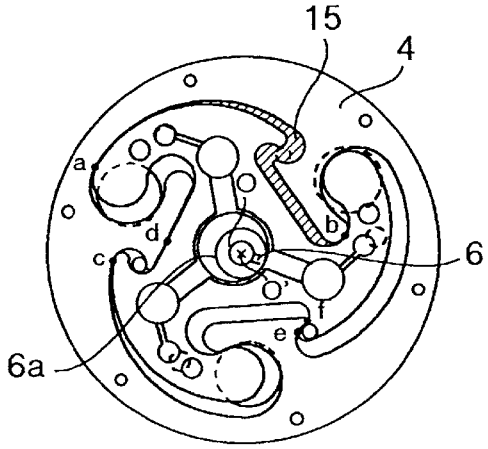
Figure 2D:
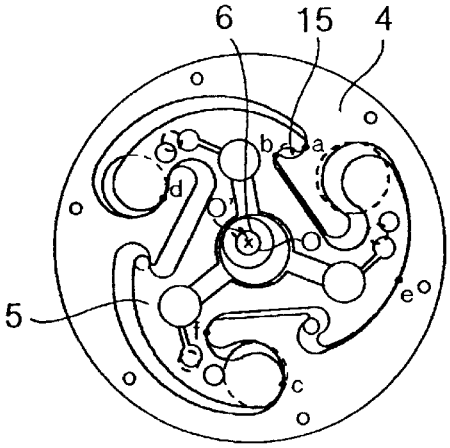
Figure 2C:
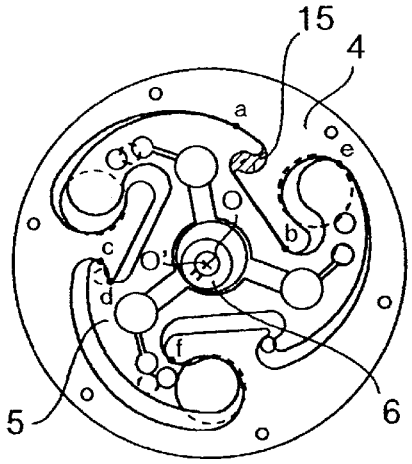
Figure 3:
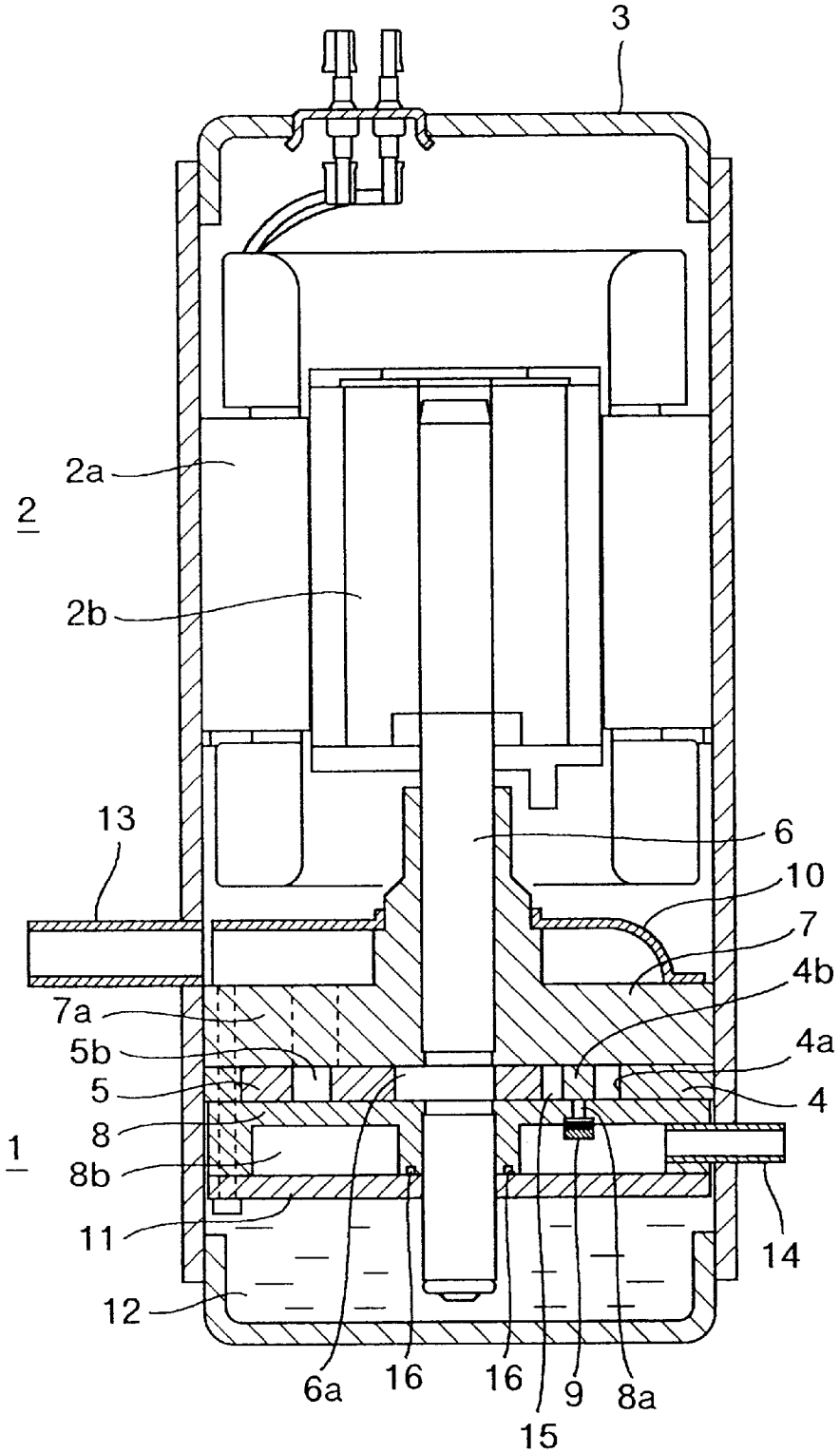
FIG. 3 is a vertical sectional view of the displacement type fluid machine according to the present invention.

The above features of the present invention will be more apparent by the following embodiments. Hereinafter, embodiments of the present invention will be described with reference to drawings. At first, the construction of a displacement type fluid machine according to an embodiment of the present invention will be described with reference to FIGS. 1A to 3. FIG. 1A is a vertical sectional view of the principal part of a hermetic type compressor wherein a displacement type fluid machine according to the present invention is used as the compressor. This figure corresponds to a sectional view taken along line IA—IA in FIG. 1B. FIG. 1B is a plan view along line IB—IB in FIG. 1A, showing formation of a compression chamber. FIGS. 2 are views for illustrating the principle of operations of a displacement type compression element. FIG. 3 is a vertical sectional view of the hermetic type compressor.

Referring to FIGS. 1A, 1B and 3, a displacement type compression element 1 and a motor element 2 for driving it are provided in a hermetic container 3. The detail of the displacement type compression element 1 will be described. FIG. 1B shows a triple wrap in which three contour portions of the same shape are combined. A cylinder 4 has an inner periphery shaped such that hollow portions of the same shape appear at intervals of 120° (around the center O'). Substantially arched vanes 4*b* protruding inward are formed at end portions of the hollow portions, respectively. In this case, the number of vanes 4*b* is three because the wrap is triple. A displacer 5 is disposed in the cylinder 4 with their centers being distant from each other by $\epsilon$, such that the displacer 5 engages with inner peripheral walls 4*a* (portions having a greater curvature than portions of the vanes 4*b*) and vanes 4*b* of the cylinder 4. When the center O of the displacer 5 is located on the center O' of the cylinder 4, gaps of a certain size as a base shape are formed between the contours of them. Each of the gaps formed between the displacer and cylinder corresponds to the radius of gyration. It is desirable that the gaps correspond to the radius of gyration throughout the whole periphery. But, so far as working chambers formed by the outer contour of the displacer and the inner contour of the cylinder operate correctly, there may be a portion at which the above relation is not satisfied.

Next, the principle of operations of the displacement type compression element 1 will be described with reference to FIGS. 1A to 1D. The reference O denotes the center of the displacer 5 and the reference O' denotes the center of the cylinder 4 (or a rotating shaft 6). References a, b, c, d, e and f denote contact points when the displacer 5 engages with the inner peripheral walls 4*a* and vanes 4*b* of the cylinder 4.

In the shape of the inner contour of the cylinder 4, three of the same combinations of curves are successively and smoothly connected to one another. Viewing one of them, the curve forming the inner peripheral wall 4*a* and vane 4*b* can be considered a vortex curve with a thickness (starting from the tip of the vane 4*b*). The inner wall curve (g-a) is a vortex curve whose wrap angle, which is the sum of arc angles constituting the curve, is substantially 360°. (Here, "substantially 360°" means that each vortex curve is designed in order to obtain the wrap angle of 360° but the just value may not be obtained due to some error in manufacturing. Similar expressions will be used below. The detail of the wrap angle will be described later.) The outer wall curve (g-b) is also a vortex curve having a wrap angle of substantially 360°. The inner peripheral contour at each combination part is formed of the inner and outer wall curves. Sets of these curves are disposed on a circle at substantially constant pitches (in this case, 120° because the wrap is triple), and the outer wall curve and inner wall curve of neighboring vortices are connected through a smoothly connecting curve (b-b') such as an arc, so that the whole of the inner peripheral contour of the cylinder 4 is formed. The outer peripheral contour of the displacer 5 is also formed in the same manner as the cylinder 4.

In the above description, the vortices each comprising three curves are disposed on a circle at substantially constant pitches (120°). This is for evenly dispersing the load caused by a compression operation described later and for easiness in manufacture. If these advantages are not required, the pitches may not be constant.

Operations for compression by the cylinder 4 and displacer 5 constructed as above will be described with reference to FIGS. 2. Three suction ports 7*a* and three discharge ports 8*a* are formed in the corresponding end plates, respectively. By rotating the rotating shaft 6, the displacer 5 revolves around the center O' of the cylinder 4 on the stator side with a gyration radius $\epsilon$ (=OO') without rotating on its own axis, so as to form working chambers 15 (always three chambers in this embodiment) around the center O of the displacer 5. (Here, the term "working chamber" is used for a space in a process of compression (discharge) after completion of suction among spaces defined and sealed by the inner peripheral contour (inner wall) of the cylinder and the outer peripheral contour (side wall) of the displacer. Namely, it is a space in the period from suction completion to discharge completion. In case of the wrap angle of 360° as described above, such a space vanishes at the time of completion of compression but the suction is also completed at the same time. So the space is also counted in. In case of a pump, the term "working chamber" is used for a space communicating with the exterior through a discharge port.) Now, a description will be made with reference to a working chamber located between the contact points a and b, which is made prominent by hatching. Although this working chamber is divided into two parts at the time of suction completion, they are united immediately when the following compression process starts. FIG. 2A shows a state of completing a suction process of a working gas to this working chamber through the suction port 7*a*. FIG. 2B shows a state that the rotating shaft 6 rotates by 90° from the state of FIG. 2A. FIG. 2C shows a state that the rotating shaft 6 rotates by 180° from the state of FIG. 2A. FIG. 2D shows a state that the rotating shaft 6 rotates by 270° from the state of FIG. 2A. When the rotating shaft 6 further rotates by 90° from the state of FIG. 2D, it returns to the state of FIG. 2A. As the rotation of the rotating shaft 6 progresses in this manner, the working chamber 15 reduces its volume to compress the working fluid because the discharge port 8*a* is closed by operation of a discharge valve 9 (refer to FIG. 1A). When the pressure in the working chamber 15 becomes higher than the pressure of the exterior (called discharge pressure), the discharge valve 9 is automatically opened due to the pressure difference to discharge the compressed working gas through the discharge port 8*a*. The rotational angle of the rotating shaft 6 from the suction completion to the discharge completion is 360°. While a compression and discharge process is carried out, the next suction process is prepared. At the time of the suction completion, the next compression process starts. For example, viewing the space defined by the contact points a and d, a suction process through the suction port 7*a* has already started in the state of FIG. 2A. As the rotation progresses, the volume of the space increases. In the state of FIG. 2D, the space is divided. The fluid quantity corresponding to the separated quantity due to the division of the space is compensated from the space defined by the contact points b and e.

The manner of compensating will be described in detail. In the state of FIG. 2A, the space defined by the contact points a and d neighboring the working chamber defined by the contact points a and b, has already started a suction process. This space is divided in the state of FIG. 2D after it once expands as shown in FIG. 2C. Hence, all of the fluid in the space defined by the contact points a and d is not compressed in the space defined by the contact points a and b. The same fluid quantity as that in the volume of fluid having not entered the divided space defined by the contact points a and d, is compensated by the fluid having entered the space defined by the contact points e and b near the discharge port, which space is formed by the manner that the space defined by the contact points b and e in a suction process in the state of FIG. 2D is divided as shown in FIG. 2A. This is because the wrap portions are disposed at constant pitches as described above. That is, because either of the displacer and cylinder is shaped by repeating the same contour, it is possible to compress substantially the same fluid quantity in any working chamber even when it obtains the fluid from different spaces. Even in case of unequal pitch, it is possible to make the machine so that spaces of the same volume are provided, but the productivity becomes bad. In any of the above prior arts, a space in a suction process is closed so that the fluid therein is compressed and discharged as it is. In contrast with this, it is one of the advantageous features of this embodiment that a space in a suction process neighboring a working chamber is divided to carry out a compression operation.

As described above, the working chambers for carrying out continuous compression operations are disposed at substantially constant pitches around a crank portion 6a of the rotating shaft 6 located at the central portion of the displacer 5, and carry out the compression operations in different phases with one another. That is, with respect to each space, the rotational angle of the rotating shaft from suction to discharge is 360°. In case of this embodiment, three working chambers are provided and they discharge the working fluid in shifted phases from one another by 120°. As a result, in case of a compressor for compressing a refrigerant of a fluid, the cooling medium is discharged three times for 360° of the rotational angle of the rotating shaft.

Considering a space (the space defined by the contact points a and b) at the moment of completing a compression operation to be one space, in case of the wrap angle of 360° like this embodiment, the compressor is designed so as to alternate a space in suction process and a space in compression process in any operation state of the compressor. As a result, immediately when a compression process is completed, the next compression process can be started, and so the fluid can be compressed smoothly and successively.

Next, the compressor including the displacement type compression element 1 of the above shape will be described with reference to FIGS. 1A, 1B and 3. Referring to FIG. 3, the displacement type compression element 1 includes, in addition to the cylinder 4 and displacer 5 as described above in detail, a rotating shaft 6 for driving the displacer 5 by the manner that a crank portion 6*a* engages with a bearing portion 5*a* in the central portion of the displacer 5, a main bearing member 7 and an auxiliary bearing member 8 functioning as end plates for closing openings at both ends of the cylinder 4 and as bearings for the rotating shaft 6, suction ports 7*a* formed in the end plate of the main bearing member 7, discharge ports 8*a* formed in the end plate of the auxiliary bearing member 8, and discharge valves 9 for opening and closing the discharge ports 8*a* by pressure difference. The discharge valves 9 may be of a lead valve type. In FIG. 3, a reference 5*b* denotes a through hole formed in the displacer 5, a reference 10 does a suction cover attached to the main bearing member 7, and a reference 11 does a discharge cover united with the auxiliary bearing chamber 8 to define a discharge chamber 8*b*.

The motor element 2 comprises a stator 2*a* and a rotor 2*b*. The rotor 2*b* is fixed to the rotating shaft 6 by shrink-fit or the like. In order to enhance the motor efficiency, the motor element 2 is constructed as a brushless motor and driven under the control of a three-phase inverter. Otherwise, the motor element 2 may be constructed as another motor type, for example, a DC motor or an induction motor.

A lubricating oil 12 is stored in the bottom portion of the hermetic container 3. The lower end portion of the rotating shaft 6 is soaked in the lubricating oil 12. A reference 13 denotes a suction pipe, a reference 14 does a discharge pipe, and a reference 15 does one of the above-described working chambers formed by engagement of the inner peripheral walls 4*a* and vanes 4*b* of the cylinder 4 and the displacer 5. The discharge chamber 8*b* is separated from the pressure in the hermetic container 3 with a sealing member 16 such as an O-ring.

In case that the displacement type fluid machine of this embodiment is used as a compressor for air-conditioning, the flow path of the working gas (refrigerant) will be described with reference to FIG. 1A. As shown by arrows in FIG. 1A, the working gas having entered the hermetic container 3 through the suction pipe 13, enters in the suction cover 10 attached to the main bearing member 7, and then enters the displacement type compression element 1 through the suction port 7*a*. In the displacement type compression element 1, the displacer 5 is gyrated by rotation of the rotating shaft 6 and thereby the volume of the working chamber is reduced to compress the working gas. The compressed working gas then passes through the discharge port 8*a* formed in the end plate of the auxiliary bearing member 8, and pushes up the discharge valve 9 to enter the discharge chamber 8*b*. The working gas then passes through the discharge pipe 14 to flow out to the exterior. The reason why a gap is formed between the suction pipe 13 and suction cover 10 is that a part of the working gas is allowed to flow in the motor element 2 to cool the motor element 2.

The lubricating oil 12 stored in the hermetic container 3 is fed to each sliding portion for lubrication, from the bottom portion of the hermetic container 3 through a hole formed in the interior of the rotating shaft 6, by different pressure or centrifugal pump operation. A part of the lubricating oil 12 is fed to the interior of the working chamber through a gap.

Figure 4:
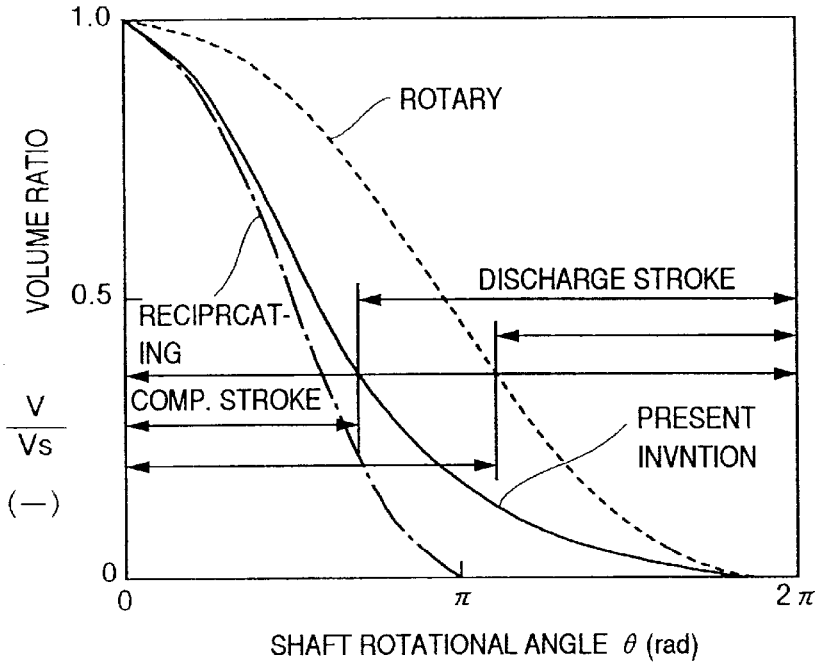
FIG. 4 is a graph showing the volume change characteristic of a working chamber in the present invention.

Operations and effects of multiple wrap in such a displacement type fluid machine will be described below. FIG. 4 shows a characteristic of change in the volume of a working chamber according to the present invention (expressed with the ratio of the working chamber volume V to the suction volume Vs) in comparison with those of other types of compressors. In FIG. 4, the horizontal axis represents the rotational angle θ of the rotating shaft from the time of suction completion. Referring to FIG. 4, in case of comparing under operation conditions of a kind of air conditioner of the volume ratio of 0.37 at the start of discharge (for example, when the working gas is hydrochlorofluorocarbon HCFC or hydrofluorocarbon 22, the suction pressure Ps=0.64 MPa and the discharge pressure Pd=2.07 MPa), the volume change characteristic in the displacement type compression element 1 according to this embodiment is substantially equal to that of reciprocating type. Because compression process is completed in a short time, leakage of the working gas is reduced and it is possible to improve the capacity and efficiency of the compressor. Besides, discharge process becomes about 50% longer than that of rotary type (rolling piston type). Because the flow velocity at discharge decreases, the pressure loss is reduced. It is possible considerably to reduce the fluid loss (over-compression loss) in discharge process and so improve the performance.

Figure 5:
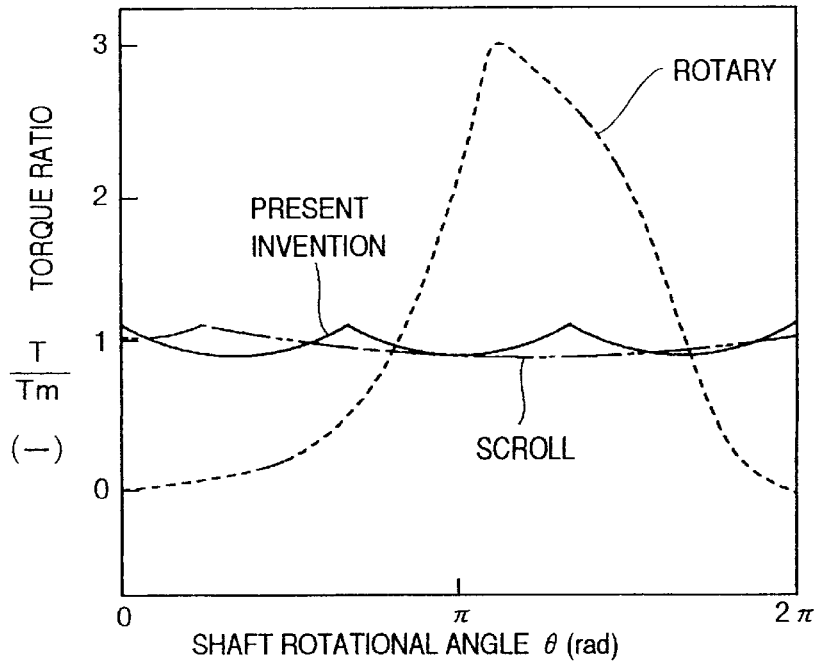
FIG. 5 is a graph showing change in gas compression torque in the present invention.

FIG. 5 shows change in work load in one rotation of the rotating shaft, namely, change in gas compression torque T according to this embodiment in comparison with those of other types of compressors (where Tm represents the mean torque). Referring to FIG. 5, variation of torque in the displacement type compression element 1 according to the present invention is very small as about 1/10 of that of rotary type, and almost equal to that of scroll type. But, because the compressor according to the present invention does not have a reciprocating mechanism for preventing a gyration scroll from rotating, such as an Oldham's coupling of scroll type, it is possible to balance the rotating shaft system and to reduce vibration and noise of the compressor.

Besides, as described above, because the contour of the multiple wrap does not have a long vortex shape like scroll type, it is possible to reduce the working time and cost. Further, because there is no end plate (mirror plate) for keeping the vortex shape, working in the same extent as that of rotary type is possible differently from scroll type in which working by a working tool penetrating is impossible.

Further, because no thrust load due to gas pressure acts on the displacer, it is easy to manage the axial clearance, which may greatly affect the performance of the compressor, in comparison with a scroll type compressor. It is therefore possible to improve the performance. Further, the thickness can be decreased in comparison with a scroll type compressor having the same volume and the same outside diameter as a result of calculation, and it is possible to downsize and lighten the compressor.

Next, the relation between the above wrap angle and the rotational angle θ*c* of the rotating shaft from suction completion to discharge completion (called compression process) will be described. Although a case of the wrap angle of 360° is described in the above embodiment, it is possible to change the rotational angle θ*c* of the rotating shaft by changing the wrap angle. For example, because the wrap angle is 360° in FIGS. 2A to 2D, the stroke condition comes back to the beginning by the rotational angle of 360° from suction completion to discharge completion. If the rotational angle θ*c* of the rotating shaft from suction completion to discharge completion is decreased by changing the wrap angle to be less than 360°, a state that the discharge port 8*a* communicates with the suction port 7*a*, is brought about. This causes a problem that the once sucked fluid flows back due to the expansion of the fluid in the discharge port 8*a*. When the wrap angle is changed to be more than 360°, the rotational angle θ*c* of the rotating shaft from suction completion to discharge completion also increases to be more than 360°, and two working chambers having different sizes are formed while the fluid passes through a space of the suction port 8*a* from suction completion. When this is used as a compressor, because the pressures in these working chambers rise differently from each other, an irreversible mixture loss is generated when both join. This causes an increase in compression power. If it is attempted to use the machine as a liquid pump, because there is formed a working chamber not communicating with the discharge port 8*a*, it is hard to apply the machine as the pump. For this reason, it is desirable that the wrap angle is 360° as far as it can within the range of an allowable precision.

The rotational angle θ*c* of the rotating shaft in compression process in the above Japanese Patent Application Laid-open No. 23353/1970 (cited reference 1) is θ*c*=180°, and that in the Japanese Patent Application Laid-open No. 202869/1993 (cited reference 3) or Japanese Patent Application Laid-open No. 280758/1994 (cited reference 4) is θ*c*=210°. The period from completing discharge of working fluid to starting the next compression process (suction completion) is 180° of the rotational angle of the rotating shaft in the cited reference 1, and 150° in the cited references 3 and 4.

Figure 6A:
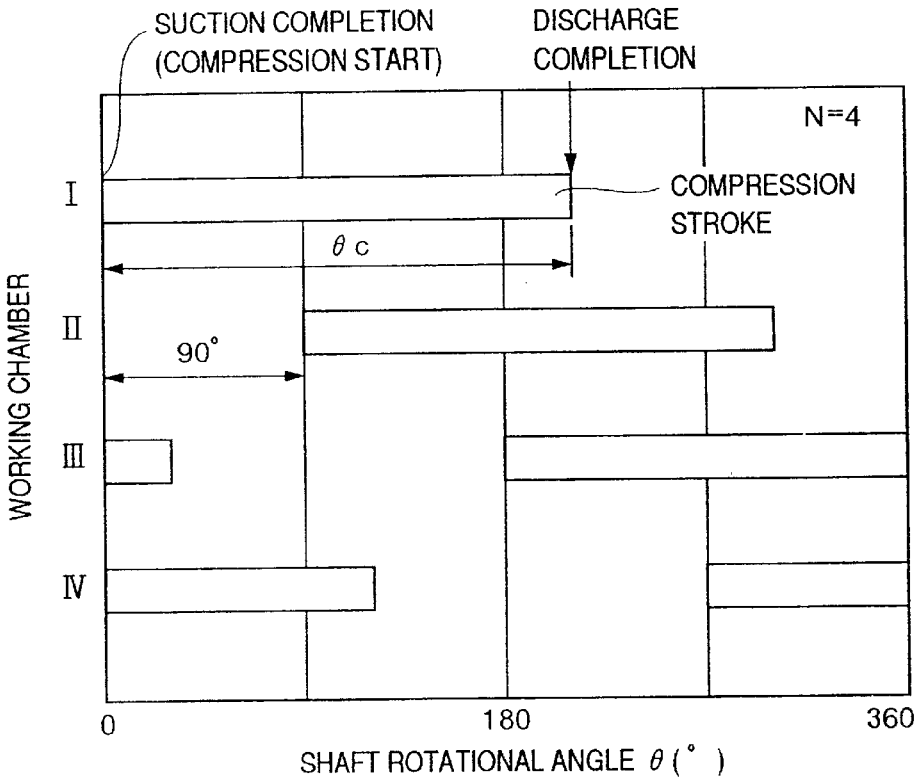
FIGS. 6A and 6B are timing charts for illustrating the relation between the rotational angle of a rotating shaft and working chambers in case of a quadruple wrap.
Figure 6B:
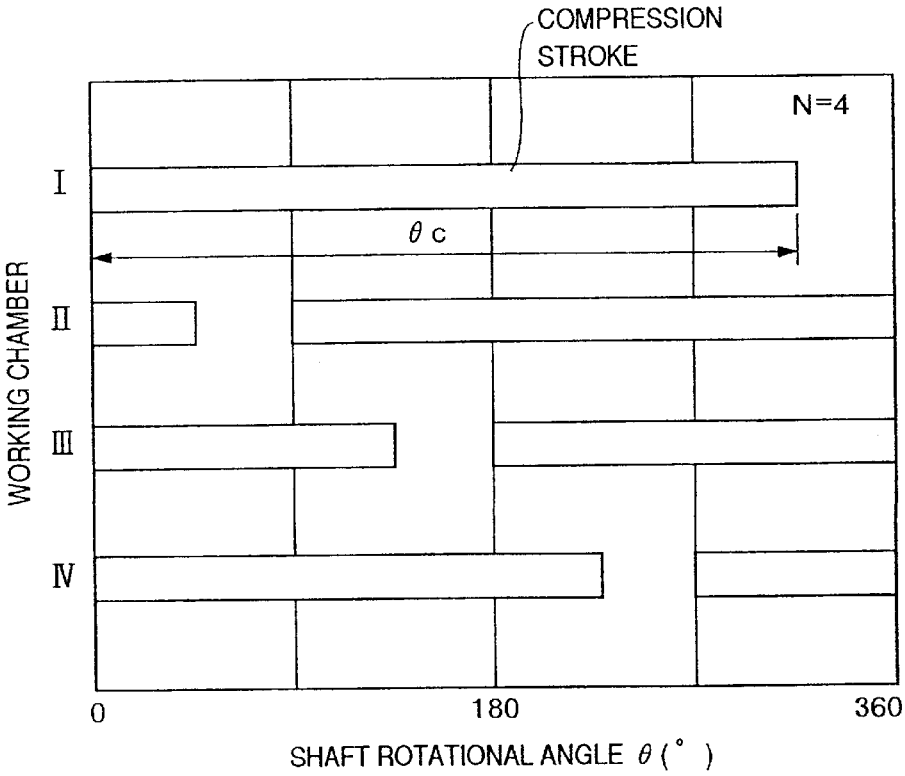

FIG. 6A shows compression processes of working chambers (indicated by references I, II, III and IV) in one rotation of the shaft when the rotational angle θ*c* of the rotating shaft in compression process is 210°. The number N of wrap portions is N=4. Although four working chambers are formed in 360° of the rotational angle θ*c* of the rotating shaft, the number n of working chambers simultaneous at each angle is n=2 or 3. The maximum of the number of simultaneous working chambers is three that is less than the number of wrap portions.

Figure 7A:
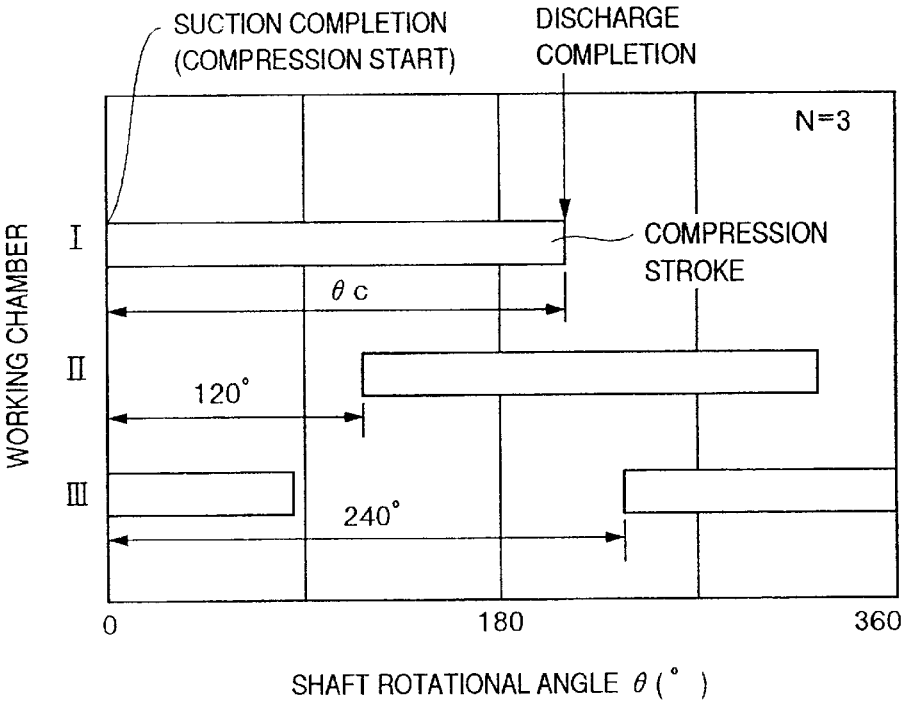
FIGS. 7A and 7B are timing charts for illustrating the relation between the rotational angle of a rotating shaft and working chambers in case of a triple wrap.
Figure 7B:
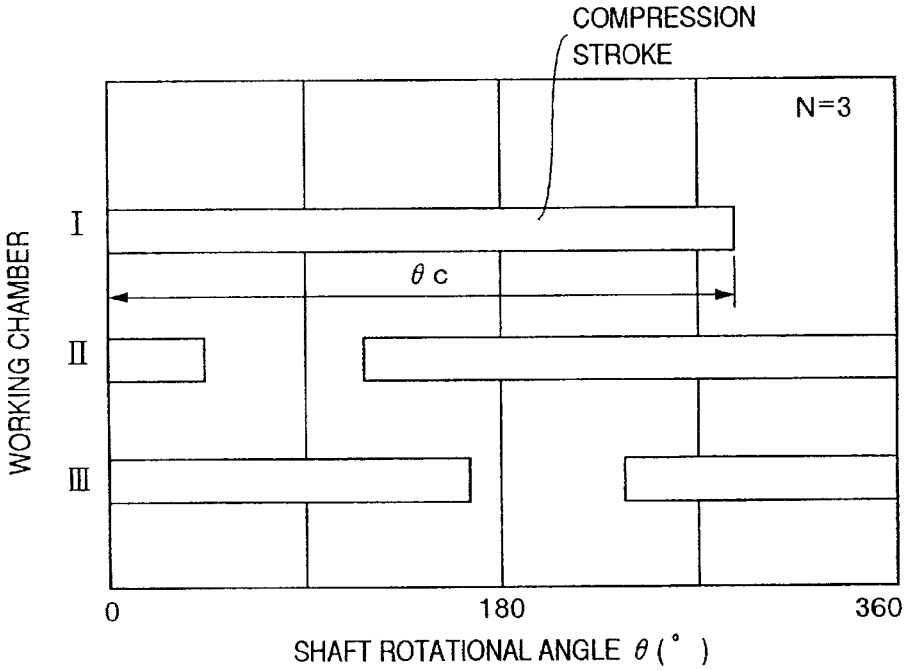

Similarly, FIG. 7A shows a case that the number of wrap portions is N=3 and the rotational angle θ*c* of the rotating shaft in compression process is 210°. Also in this case, the number n of simultaneous working chambers is n=1 or 2, and the maximum of the number of simultaneous working chambers is two that is less than the number of wrap portions.

In such cases, because working chambers are unevenly formed around the rotating shaft, there arises a dynamic unbalance, the rotating moment acting on the displacer becomes excessively high, and so the contact load between the displacer and cylinder increases. This causes problems of deterioration of the performance through an increase in mechanical friction loss and of lowering the reliability through wear of vanes.

For solving these problems, in this embodiment, the outer peripheral contour of the displacer and the inner peripheral contour of the cylinder are formed such that the rotational angle θ*c* of the rotating shaft from suction completion to discharge completion satisfies $$(((N-1)/N)\times 360^\circ)<\theta c\leqq 360^\circ \quad \text{(expression 1).}$$

In other words, the above wrap angle is within the range of the expression 1. Referring to FIG. 6A, the rotational angle θ*c* of the rotating shaft in compression process is more than 270°, and the number n of simultaneous working chambers is n=3 or 4. Hence the maximum of the number of simultaneous working chambers is four, which coincides with the number N of wrap portions (N=4). Referring to FIG. 7A, the rotational angle θ*c* of of the rotating shaft in compression process is more than 240°, and the number n of simultaneous working chambers is n=2 or 3. Hence the maximum of the number of simultaneous working chambers is three, which coincides with the number N of wrap portions (N=3).

In this manner, by making the lower limit of the rotational angle θ*c* of the rotating shaft in compression process, be more than the value of the left side of the expression 1, the maximum of the number of simultaneous working chambers is equal to the number N of wrap portions or more, and thereby, the working chambers can be disposed evenly around the rotating shaft. As a result, the dynamic balance is improved, the rotating moment acting on the displacer is reduced, and the contact load between the displacer and cylinder is also reduced. It becomes possible to improve the performance by reducing the mechanical friction loss, and to improve the reliability of contact portions.

On the other hand, the upper limit of the rotational angle θ*c* of the rotating shaft in compression process is 360° according to the expression 1. Practically, the upper limit of the rotational angle θ*c* of the rotating shaft in compression process is 360°. As described above, the time lag from completing a discharge process of working fluid to starting the next compression process (suction completion) can be made zero. It is possible to prevent the suction efficiency from lowering due to re-expansion of gas in a clearance volume, which may occur when θ*c*<360°. It is also possible to prevent the irreversible mixture loss generated at the time of joining two working chambers because the pressures in them rise differently from each other, which may occur when θ*c>360°*. The latter case will be described with reference to FIGS. 8.

Figure 8A:
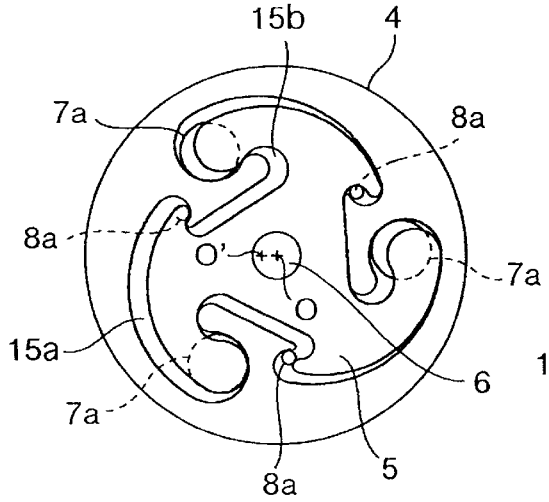
FIGS. 8A to 8C are views for illustrating operations in case of a wrap angle of the compression element more than 360°.
Figure 8B:
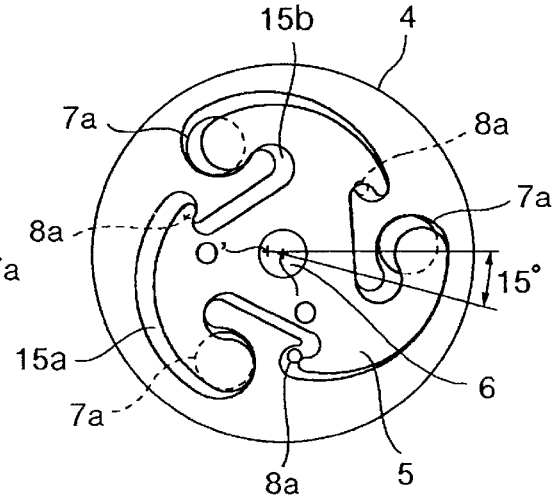
Figure 8C:
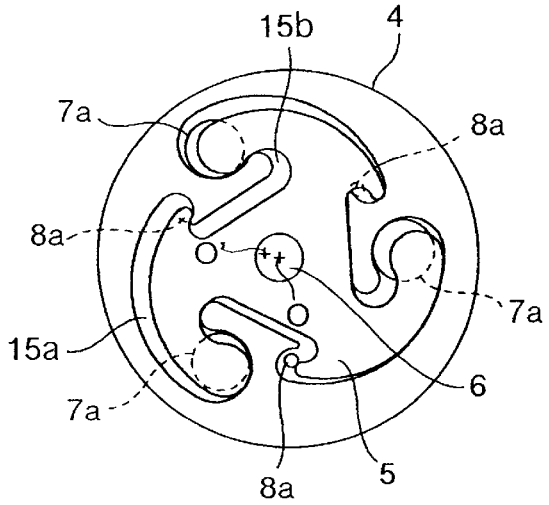

FIGS. 8A to 8C shows a displacement type fluid machine in which compression process is 375° of the rotational angle θ*c* of the rotating shaft. FIG. 8A shows a state that suction processes are completed in two working chambers 15*a* and 15*b*. At this time, the pressures in the working chambers 15*a* and 15*b* are equal to each other as the suction pressure Ps. The discharge port 8*a* is located between the working chambers 15*a* and 15*b*, and communicates with neither of them. FIG. 8B shows a state that the rotating shaft rotates by a rotational angle of 15° from the state of FIG. 8A. This is immediately before the discharge port 8*a* communicates with the working chambers 15*a* and 15*b*. At this time, the volume of the working chamber 15*a* is less than that at suction completion of FIG. 8A, and the compression process is in progress, and so the pressure therein is higher than the suction pressure Ps. In contrast with this, the volume of the working chamber 15*b* is more than that at suction completion of FIG. 8A, and the pressure therein is lower than the suction pressure Ps because of expansion. When the working chambers 15*a* and 15*b* are united (communicate with each other) at the next moment, irreversible mixture occurs as shown by an arrow in FIG. 8C. This causes a deterioration of the performance through an increase in compression power. For this reason, it is desirable that the upper limit of the rotational angle θ*c* of the rotating shaft in compression process is 360°.

Figure 9A:
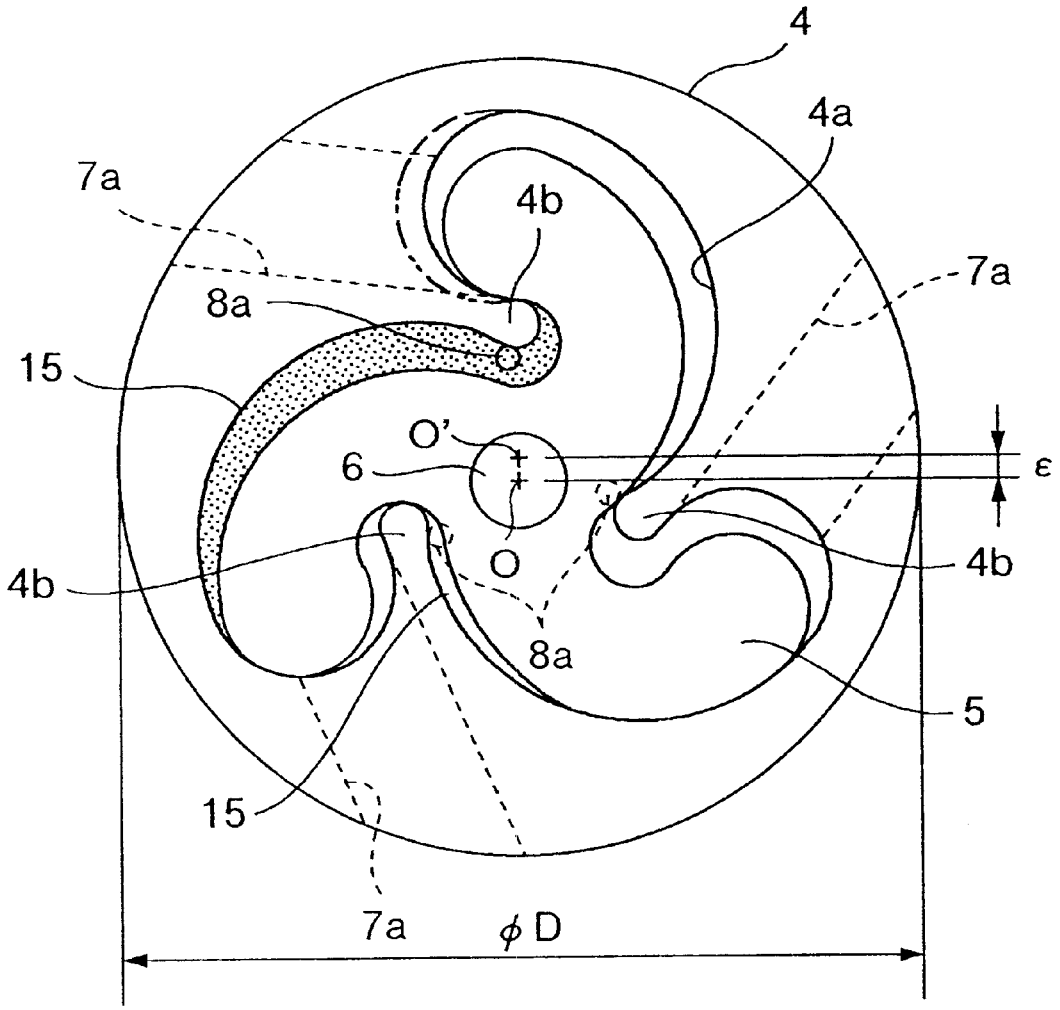
FIGS. 9A and 9B are views for illustrating an extension of the wrap angle of the compression element.
Figure 9B:
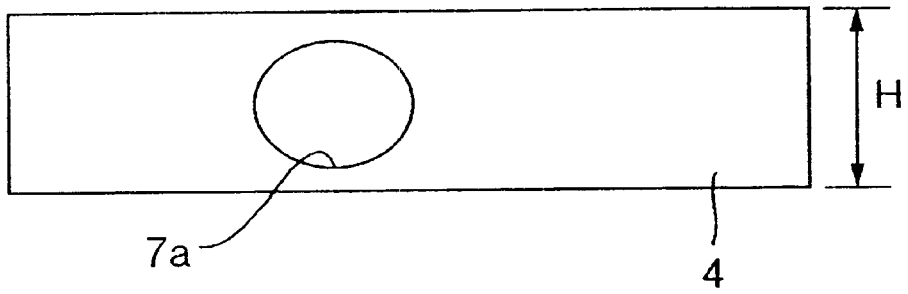

FIGS. 9A and 9B show a compression element of a displacement type fluid machine described in the cited reference 3 or 4, wherein (a) is a plan view and (b) is a side view. The number of wrap portions is three and the rotational angle θ*c* (wrap angle θ) of the rotating shaft in compression process is 210°. In this example, the number n of working chambers is n=1 or 2 as shown in FIG. 7A. FIGS. 9A and 9B show a state that the rotational angle θ of the rotating shaft is 0° and the number n of working chambers is two. As apparent from FIG. 12, the right space of spaces defined by the outer peripheral contour of the displacer and the inner peripheral contour of the cylinder does not function as working chamber, through which space the suction port 7*a* and discharge port 8*a* communicate with each other. As a result, the gas once having entered the cylinder 4 through the suction port 7*a* may flow back due to reexpansion of the gas in the clearance volume of the discharge port 8*a*. This causes a problem of lowering the suction efficiency.

Now suppose that the rotational angle θ*c* of the rotating shaft in compression process in the displacement type fluid machine shown in FIGS. 9A and 9B is extended by use of the idea of this embodiment. For extending the rotational angle θ*c* of the rotating shaft in compression process, it is required that the wrap angle of the contour curve of the cylinder 4 is made larger as shown by a double-dot line. But, because the vane 4*b* becomes extremely thin as shown in FIG. 9A, it is difficult to make the rotational angle θ*c* of the rotating shaft in compression process, more than 240° in order that the maximum of the number n of working chambers is equal to the number N of wrap portions (N=3) or more.

Figure 10A:
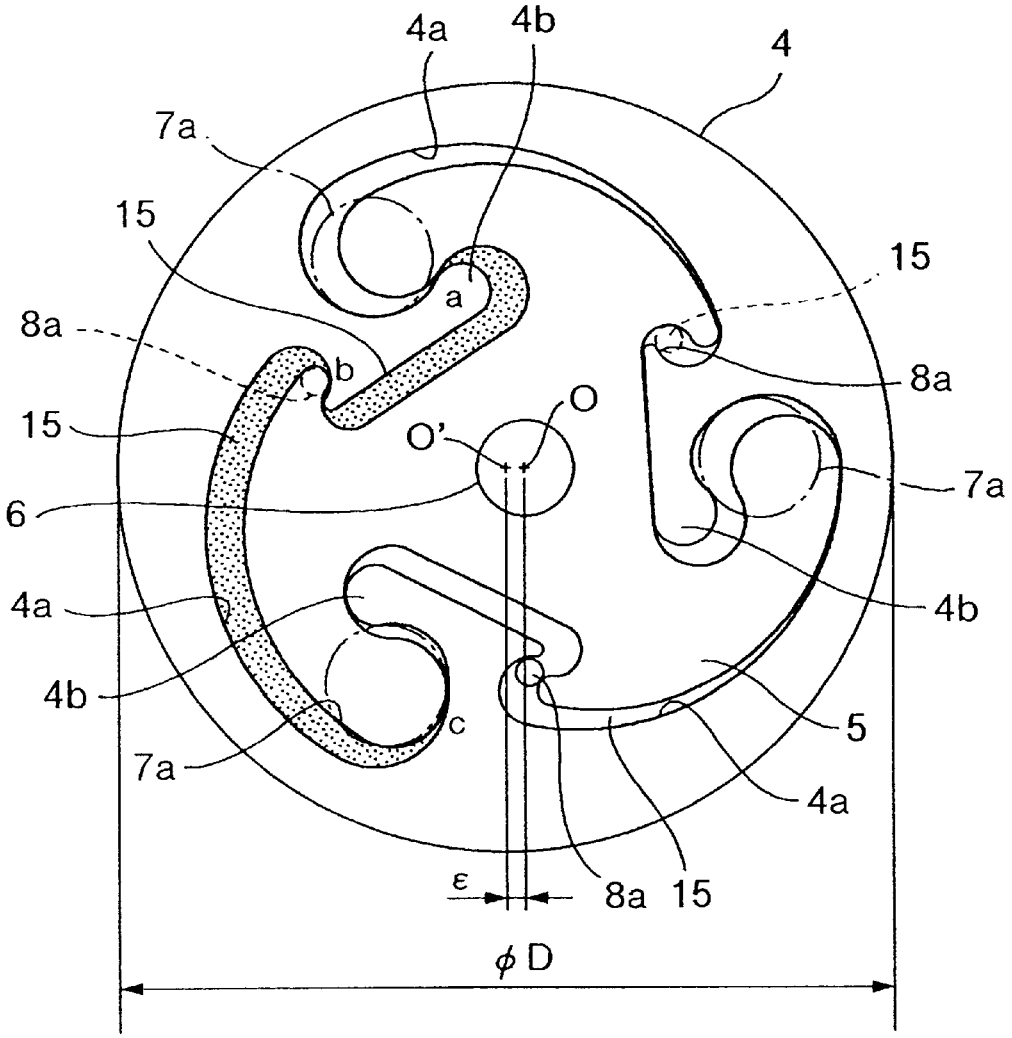
FIGS. 10A and 10B are views showing a modification of the displacement type fluid machine of FIG. 1.
Figure 10B:
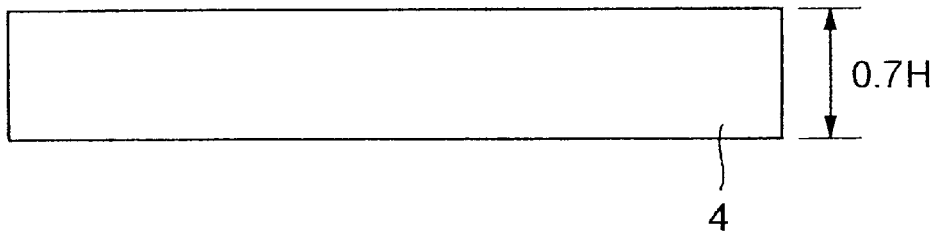

FIG. 10 shows an example of compression element of a displacement type fluid machine according to an embodiment of the present invention, which has the same stroke volume (suction volume), the same outer diameter and the same gyration radius as the displacement type fluid machine shown in FIG. 9. It is realized that the rotational angle θ*c* of the rotating shaft in compression process in the compression element shown in FIG. 10 is 360° that is more than 240°. This is for the following reasons. In the compression element shown in FIGS. 9A and 9B, because the contour between the sealing points defining a working chamber is made of a uniform curve, even if the rotational angle θ*c* of the rotating shaft in compression process is attempted t o extend based on the idea of this embodiment, it is limited to 240° at the most. In contrast with this, in the compression element according to this embodiment shown in FIGS. 10A and 10B, the contour between the sealing points (a-c) is not made of a uniform curve but formed such that a portion near the contact point b extrudes relatively to the displacer and each wrap portion of the displacer has a constricted portion in between the central portion of the displacer and the tip portion of each wrap portion. These features were already shown in the embodiment of FIGS. 1A and 1B. In this shape, the wrap angle from the contact point a to the contact point b can be 360° that is more than 240°, and the wrap angle from the contact point b to the contact point c can be 360° that is more than 240°. As a result, the rotational angle θ*c* of the rotating shaft in compression process can be 360° that is more than 240°, and the maximum of the number n of working chambers can be equal to the number N of wrap portions or more. It is thus possible to dispose working chambers evenly and so reduce the rotating moment.

Further, because the number of working chambers that can function effectively is increased, when the height (thickness) of the cylinder of the compression element shown in FIGS. 9A and 9B is H, the height of the cylinder of the compression element shown in FIGS. 10A and 10B is 0.7H that is 30% less. It is thus possible to downsize the compression element.

Next, the load and moment acting on the displacer 5 will be described. Referring to FIG. 1B, as the working gas is compressed, a tangential force Ft perpendicular to the direction of eccentricity and a radial force Fr in the direction of eccentricity act on the displacer 5 due to the internal pressure of each working chamber 15. Because of a shift (arm length 1) of the resultant force F of the forces Ft and Fr from the center O of the displacer 5, a rotating moment M (=F·1) acts to rotate the displacer 5 counterclockwise. This rotating moment M is sustained by reaction forces at the contact points a and d between the displacer 5 and cylinder 4 (this is the same in the other working chambers). In this multiple wrap, two or three contact points near the suction port 7*a* always receive the moment and no reaction force acts at any other contact point. In this displacement type compression element 1, working chambers in which the rotational angle of the rotating shaft from suction completion to discharge completion is substantially 360°, are disposed at substantially constant pitches around the crank portion 6*a* of the rotating shaft 6 engaging with the central portion of the displacer 5. As a result, the acting point of the resultant force F can be put close to the center O of the displacer 5. It is thus possible to shorten the arm length 1 of the moment to reduce the rotating moment M. The reaction forces are reduced accordingly. Besides, as understood from the positions of the contact points a and d, because sliding portions of the displacer 5 and cylinder 4 receiving the rotating moment M are near the suction port 7*a* for the working gas at a low temperature and with a high oil viscosity, oil films on the sliding portions are ensured. It is thus possible to provide a highly reliable displacement type fluid machine in which the problems on friction and wear has been solved.

Figure 11:
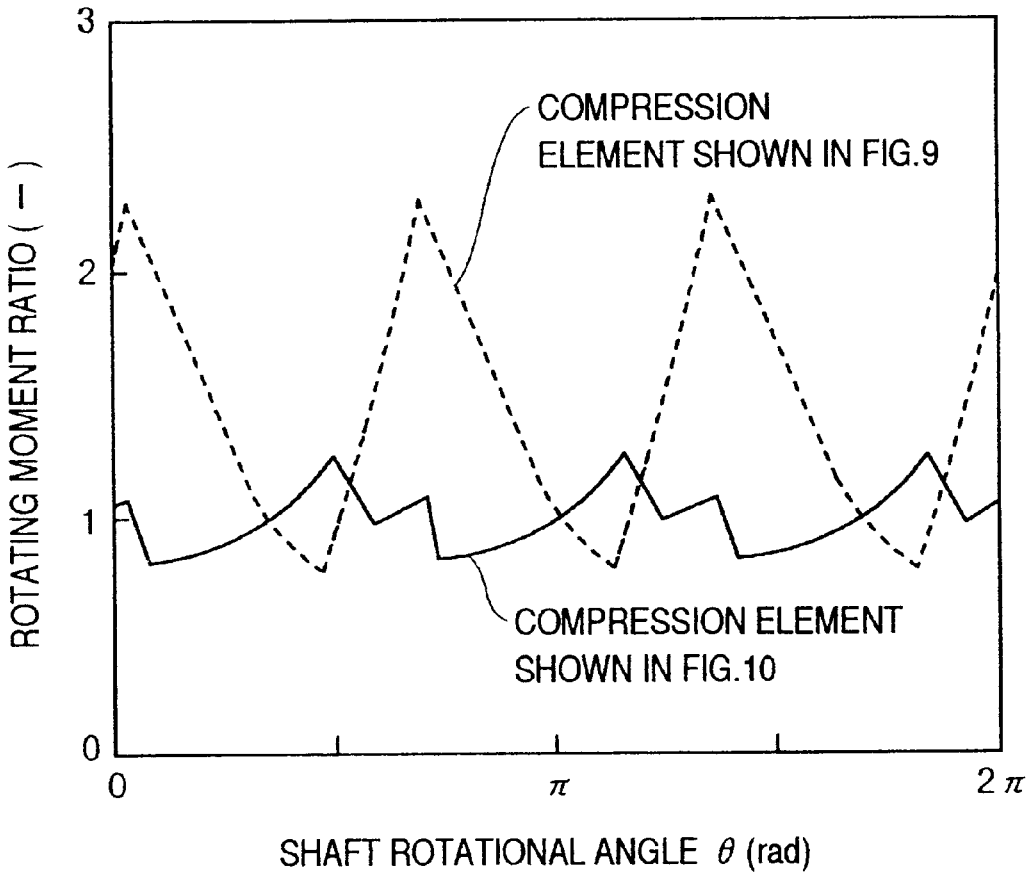
FIG. 11 is a graph showing the relation between the rotational angle of the rotating shaft and the rotating moment ratio of the compression element.

FIG. 11 shows rotating moments M in one rotation of the shaft acting on the displacer due to the internal pressure of working fluid, for comparing the compression element shown in FIGS. 9 and the compression element shown in FIGS. 10 with each other. Calculation conditions are refrigeration conditions of a working fluid HFC134a (the suction pressure Ps=0.095 MPa and the discharge pressure Pd=1.043 MPa). Referring to FIG. 11, in the compression element according to this embodiment wherein the maximum of the number n of working chambers is equal to the number of wrap portions or more, because working chambers from suction completion to discharge completion are disposed at substantially constant pitches around the rotating shaft, the dynamic balance is improved and it is possible to make the load vectors point substantially the center. It is thus possible to reduce the rotating moment M acting on the displacer. As a result, the contact load between the displacer and cylinder is also reduced, so that it is possible to improve the mechanical efficiency and to improve the reliability as compressor.

Here, the relation between the period that the suction port 7*a* and discharge port 8*a* communicate with each other, and the rotational angle of the rotating shaft in compression process will be described. The period that the suction port 7*a* and discharge port 8*a* communicate with each other, namely, the time lag Δθ expressed by the rotational angle of the rotating shaft for the period from completing a discharge of the working fluid to starting the next compression process (suction completion), is given by $\Delta\theta=360°-\theta c$ where the rotational angle of the rotating shaft in compression process is θ*c*.

When $\Delta\theta \leqq 0°$, because there is no period that the suction port and discharge port communicate with each other, there is no reduction in the suction efficiency due to re-expansion of gas in the clearance volume on the discharge port.

When $\Delta\theta > 0°$, because there is a period that the suction port and discharge port communicate with each other, the suction efficiency is reduced due to reexpansion of gas in the clearance volume on the discharge port, and the (refrigeration) capacity of the compressor is reduced. Besides, the reduction in the suction efficiency (volumetric efficiency) causes a reduction in the adiabatic efficiency, which is the energy efficiency of the compressor, or the coefficient of performance.

The rotational angle $\theta c$ of the rotating shaft in compression process is determined in accordance with the wrap angle of the contour curve of the displacer or cylinder, and the locations of the suction port and discharge port. When the wrap angle of the contour curve of the displacer or cylinder is 360°, the rotational angle $\theta c$ of the rotating shaft in compression process can be 360°. In this case, by shifting the sealing point of the suction port or discharge port, $\theta c<360°$ is also possible. But $\theta c>360°$ is impossible. For example, the rotational angle $\theta c=375°$ of the rotating shaft in compression process in the compression element shown in FIGS. 8 can be changed into $\theta c=360°$ by changing the location or size of the discharge port. This is possible by enlarging the discharge port such that the working chambers 15*a* and 15*b* communicate with each other immediately after suction completion in FIGS. 8A to 8C. By this change, it is possible to reduce the irreversible mixture loss which occurs due to the difference in pressure rising between the two working chambers when $\theta c=375°$. Hence, the wrap angle of contour curve is a necessary condition but not a sufficient condition for determining the rotational angle $\theta c$ of the rotating shaft in compression process.

In the above-described embodiment, that is, the embodiment shown in FIG. 3, there has been described a sealing type compressor wherein the pressure in the hermetic container 3 is kept at a low pressure (suction pressure). Such a low-pressure type has the following advantages.

(1) Because the motor element 2 is less heated by the compressed working gas at a high temperature and cooled by the suction gas, the temperatures of the stator 2*a* and rotor 2*b* fall and so the motor efficiency is improved to improve the performance.

(2) In case of a working fluid soluble in a lubricating oil 12 such as hydrochlorofluorocarbon or hydrofluorocarbon, the rate of the dissolved working gas in the lubricating oil 12 is less because of a low pressure. The oil is hard to bubble in a bearing portion or the like, and so the reliability is improved.

(3) It is possible to lower the capacity to pressure of the hermetic container 3, and so the container can be made slim and light.

Figure 12:
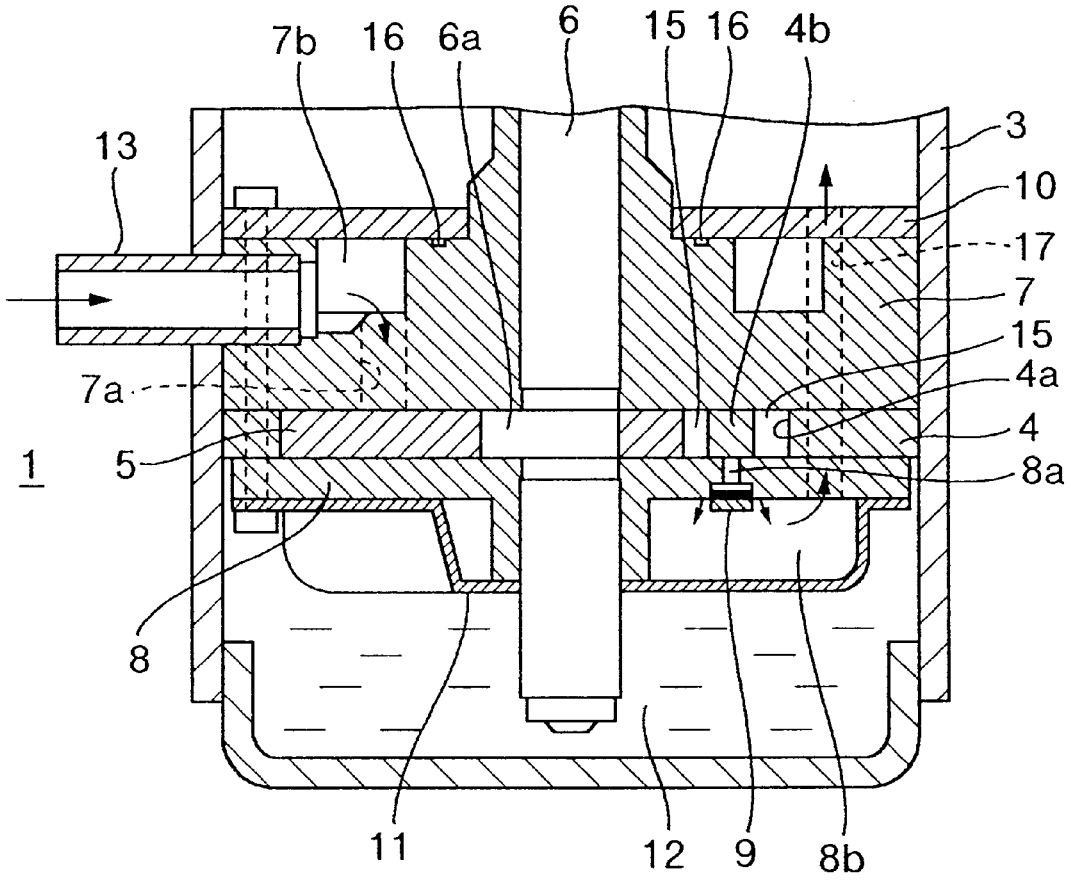
FIG. 12 is a vertical sectional view of the principal part of a hermetic type compressor according to another embodiment of the present invention.
Figure 13A:
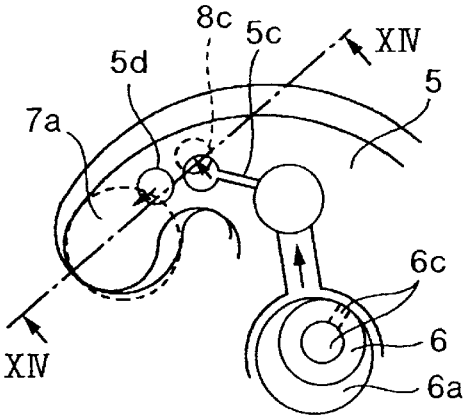
FIGS. 13A to 13F are enlarged views of the suction port part of FIG. 1B.
Figure 13B:
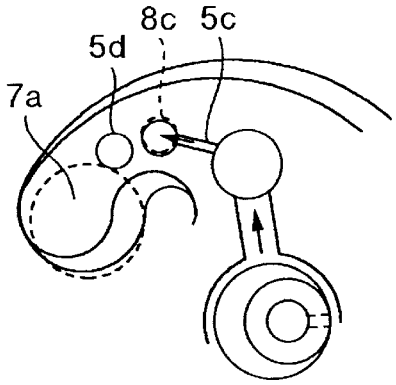
Figure 13C:
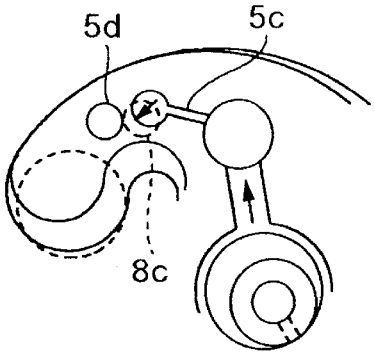
Figure 13D:
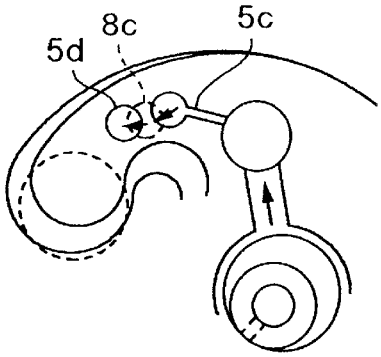
Figure 13E:
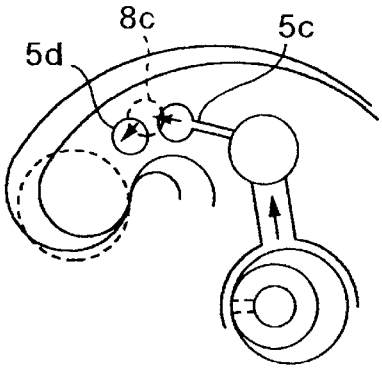
Figure 13F:
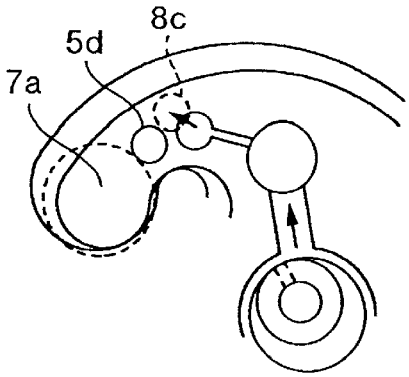
Figure 14A:
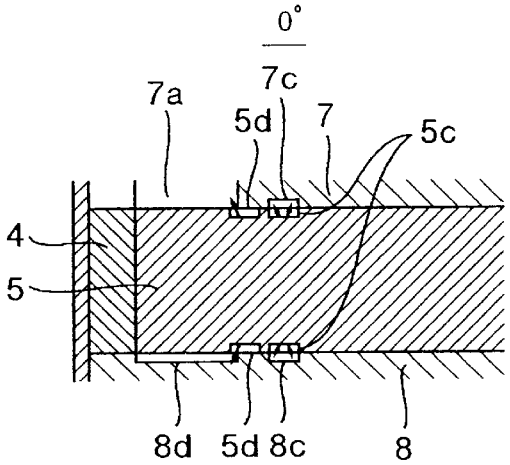
FIGS. 14A to 14F are sectional views taken along line XIV—XIV in FIGS. 13.
Figure 14B:
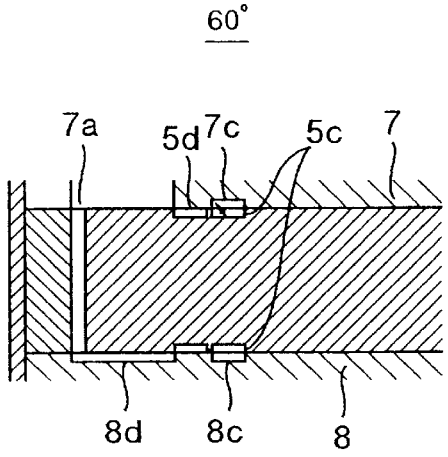
Figure 14C:
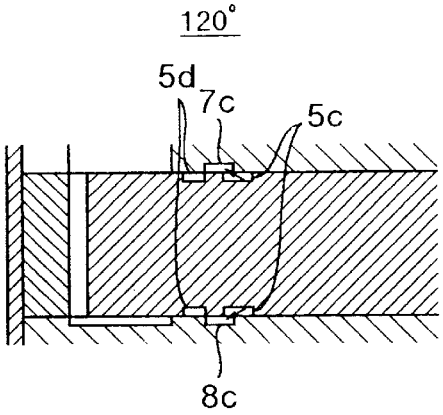
Figure 14D:
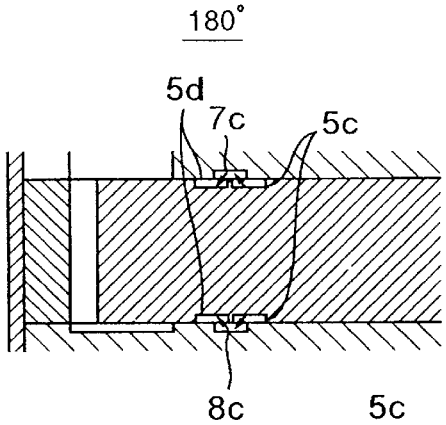
Figure 14E:
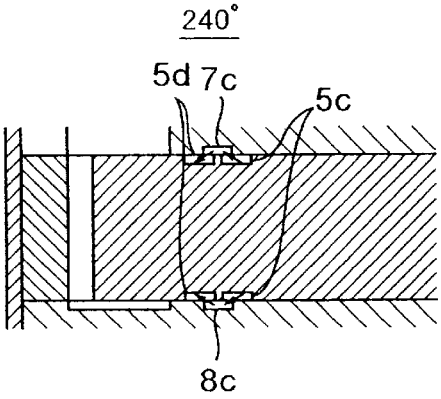
Figure 14F:
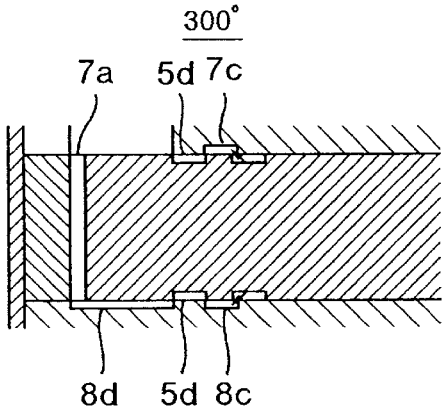

Next, a type in which the pressure in the hermetic container 3 is kept at a high pressure (discharge pressure) will be described. FIG. 12 is an enlarged sectional view of the principal part of a hermetic type compressor of a high-pressure type, to which a displacement type fluid machine according to the second embodiment of the present invention is applied. In FIG. 12, the parts corresponding to those in FIGS. 1A to 3 described above are denoted by the same references as those in FIGS. 1A to 3. They operate in the same manner as those in FIGS. 1A to 3, respectively. Referring to FIG. 12, a suction chamber 7*b* is defined by the main bearing member 7 and a suction cover 10 united with the main bearing member 7. The suction chamber 7*b* is separated from the pressure (suction pressure) in the hermetic container 3 by a sealing member 16 or the like. A discharge passage 17 is provided for connecting the interior of the discharge chamber 8*b* to the interior of the hermetic container 3. The principle of operations, etc., of the displacement type compression element 1 are the same as that of the low-pressure (suction pressure) type described above.

As for the flow of the working gas, as shown by arrows in FIG. 12, the working gas having entered the suction chamber 7*b* through the suction pipe 13, enters the displacement type compression element 1 through the suction port 7*a* formed in the main bearing member 7. In the displacement type compression element 1, the displacer 5 is gyrated by rotation of the rotating shaft 6 and thereby the volume of the working chamber 15 is reduced to compress the working gas. The compressed working gas then passes through the discharge port 8*a* formed in the end plate of the auxiliary bearing member 8, and pushes up the discharge valve 9 to enter the discharge chamber 8*b*. The working gas then enters in the hermetic container 3 through the discharge passage 17, and then flows out to the exterior through a discharge pipe (not shown) connected to the hermetic container 3.

Such a high-pressure type has an advantage as follows. Because the lubricating oil 12 is under a high pressure, the lubricating oil 12 having been fed to the sliding portions of each bearing portion by centrifugal pump operation or the like by rotation of the rotating shaft 6, is easy to feed in the cylinder 4 through a gap or the like near an end surface of the displacer 5. As a result, the capacity of sealing working chambers 15 and the capacity of lubricating slide portions can be improved.

As described above, in compressors using displacement type fluid machines according to the present invention, it is possible to select either of the low-pressure type and high-pressure type in accordance with the specification of a machine, application, or manufacturing facilities. The flexibility of design is thus improved considerably.

Next, an oil-feeding system will be described with reference to FIGS. 1A and 1B, 2A to 2D, 13A to 13F and 14A to 14F. FIGS. 13A to 13F are enlarged views near the suction port 7*a* of FIG. 1B, showing oil-feeding states at every 60° in one rotation of the rotating shaft 6 from suction completion (compression start). FIGS. 14 are sectional views taken along line XIV—XIV in FIGS. 13A to 13F.

In the displacement type fluid machine of this embodiment, the outer wall surface of the tip portion on the suction port 7*a* side of the displacer 5 slides in contact with the inner wall surface of the cylinder 4 because of the torque by rotation, as described above. This causes a problem that the insufficiency of oil is easy to occur on that portion. For this reason, this embodiment employs an oil-feeding system for feeding a lubricating oil preferentially to that portion.

The displacer 5 is provided in each end surface with an oil-feeding groove 5*c* that does not communicate with the suction port 7*a* even in gyration of the displacer 5, and an oil-feeding pocket 5*d* that communicates with the suction port 7*a* in gyration of the displacer 5. The oil-feeding groove 5*c* is always fed with a lubricating oil 12 through an oil passage 6*c* by centrifugal pump operation of the rotating shaft 6. As shown in FIGS. 13A to 14F, oil-feeding grooves (concave portions) 7*c* and 8*c* are respectively formed in the end surfaces of the main and auxiliary bearing members 7 and 8 at positions corresponding to the same positions of each wrap portion of the displacer 5 as the center O' of the cylinder 4 is the origin. An oil-receiving groove 8*d* having substantially the same shape as the suction port 7*a* is formed in the auxiliary bearing member 8 at a position opposite to the suction port 7*a*. The suction port 7*a*, oil-feeding pocket 5*d* and oil-feeding grooves 7*c* and 5*c* formed on the main bearing side and the oil-receiving groove 8*d*, oil-feeding pocket 5*d* and oil-feeding groove 8*c* and 5*c* formed on the auxiliary bearing side never communicate with one another simultaneously in each side. The oil-feeding grooves 7*c* and 8*c* are located so as to be always opposed to the end surface of the displacer 5 at any rotational position of the rotating shaft 6, and so they never open to a working chamber 15. A reference 5*b* denotes a through hole for positioning when the displacer 5 is processed. This through hole 5*b* is utilized as an oil reservoir. The lubricating oil having flowed in the through hole 5*b*, then enters between the displacer 5 and end plates (surfaces of the main and auxiliary bearing members 7 and 8 opposite to the displacer 5) by gyration of the displacer 5 to lubricate the sliding surfaces.

By the construction as described above, the proper intermittent oil feed to the vicinity of the suction port 7*a* becomes possible, and so the deterioration of the performance of the compressor due to an excessive feed of the lubricating oil 12 can be prevented.

The lubricating oil 12 stored in the bottom portion of the hermetic container 3 is sucked up by centrifugal pump operation through a oil-feeding piece 6*b* attached to the rotating shaft 6, and then fed to each sliding portion of the displacement type compression element 1 through the oil-feeding passage 6*c* formed in the rotating shaft 6. The lubricating oil 12 having passed through the oil-feeding passage 6*c* provided in the crank portion 6*a*, is fed to the oil-feeding groove 5*c* formed in the end surface of the displacer 5, through a gap between the displacer 5 and crank portion 6*a*. While the rotating shaft 6 rotates from 0° to 60°, the oil-feeding groove 5*c* communicates with the oil-feeding grooves 7*c* and 8*c* formed in the main and auxiliary bearing members 7 and 8, to feed the lubricating oil 12 as shown by arrows in FIGS. 13 and 14. While the rotating shaft 6 rotates from 120° to 240°, the oil-feeding groove 5*c* communicates with the oil-feeding pocket 5*d* through the oil-feeding grooves 7*c* and 8*c* to 5*d*. Feed the lubricating oil 12 to the oil-feeding pocket 5*d*. Feeding the lubricating oil 12 to the oil-feeding pocket 5*d* is promoted by the pressure of the oil having been fed to the oil-feeding groove 5*c* by centrifugal pump operation. Further, while the rotating shaft 6 rotates from 300° to 60°, the oil-feeding pocket 5*d* fed with the lubricating oil 12 communicates with the suction port 7*a* and oil-receiving groove 8C. At this time, in spite of a low-pressure chamber type, the suction port 7*a* side is at some negative pressure corresponding to the oil pressure caused by centrifugal pump operation. So, by the pressure difference, the lubricating oil 12 in the oil-feeding pocket 5*d* is driven in the vicinity of the suction port 7*a* to feed to the sliding portions. After fed to the suction port 7*a*, the lubricating oil 12 is driven toward the discharge port 8*a* in a manner of scratching off in the working chamber, in the process of gyration of the displacer 5. The oil-feeding passage 6*c* is so located as to feed the lubricating oil 12 to the oil-feeding groove 5*c* for the angular period that the oil-feeding groove 5*c* communicates with the oil-feeding groove 8*c*.

The above oil-feeding system is for intermittent oil feed. The reason will be described. For lubricating sliding surfaces (near the suction port 7*a*) of the outer wall surface of the tip portion on the suction port 7*a* side of the displacer 5 and the inner wall surface of the cylinder 4, it is thinkable that the oil-feeding groove 5*c* is extended beyond the oil-feeding pocket 5*d* to the vicinity of the tip of the displacer 5 so as always to feed the oil. But this measure meets the following problems. Continuously feeding the lubricating oil 12 to the tip portion of the displacer 5 causes an excessive feed of the oil. The suction gas is then heated by the warm lubricating oil 12 and increases its volume. The suction efficiency (volumetric efficiency) lowers accordingly. Besides, because a considerable amount of lubricating oil 12 enters the working chamber, a part of the working chamber is occupied by the volume of the lubricating oil 12. The effective volume of the working chamber is thus decreased by the volume of the oil. The volumetric efficiency thereby lowers and so the efficiency of the compressor lowers.

On the other hand, in case that the oil-feeding groove 5*c* is formed to the front of the oil-feeding pocket 5*d* near the tip of the displacer 5, and the lubricating oil 12 is always stored therein (lubrication between the end plate and displacer is possible), because the lubricating oil 12 is not continuously fed to the region between the outer wall surface of the tip portion on the suction port 7*a* side of the displacer 5 and the inner wall surface of the cylinder 4 unlike the above case, the above problem of an excessive feed is solved. But, because of the low-pressure chamber, the driving force for feeding the lubricating oil 12 to the oil-feeding groove 5*c* is only the centrifugal oil-feeding force. As a result, there is a problem that the pressure of the refrigerant in the working chamber becomes higher than the pressure by the centrifugal oil-feeding operation, so the oil does not reach the outer peripheral wall of the displacer 5 and the inner peripheral wall of the cylinder 4 through the gap between the displacer 5 and end plate.

For solving the above problems conflicting with each other, this embodiment employs the above oil-feeding system wherein the lubricating oil 12 is intermittently fed to the region between the outer wall surface of the tip portion on the suction port 7*a* side of the displacer 5 and the inner wall surface of the cylinder 4.

But, if the oil quantity can be kept proper in order not excessively to feed the lubricating oil, by increasing the resistance of the flow path, for example, with an oil-feeding groove 5*c* tapering in the direction from the central portion toward the tip portion of the displacer 5, a continually feeding system may be employed.

In the intermittently feeding system of this embodiment, the oil-feeding grooves 7*c* and 8*c* are used for once pooling the fed lubricating oil 12. But, even when the oil-feeding groove 5*c* is connected directly to the oil-feeding pocket 5*d* without using the oil-feeding grooves 7*c* and 8*c*, intermittently feeding the oil is possible. In that case, however, because the oil-feeding pocket 5*d* communicates with the supply source of the lubricating oil for the period that the oil-feeding pocket 5*d* opens to the suction port 7*a*, the flow path must be provided with a resistance if there is a possibility of an excessive feed.

As described above, this embodiment has effects that the vicinity of the suction port easy to slide in contact can surely be fed with the lubricating oil, that the necessary amount of lubricating oil can be fed to the vicinity of the suction port by intermittently feeding, and that the irreducibly minimum amount of lubricating oil can be fed to the vicinity of the suction port by providing the oil-feeding grooves 7*c* and 8*c*.

Besides, by changing the volume of the oil-feeding pocket 5*d*, the quantity of the oil fed to the contact portions of the cylinder 4 and displacer 5 can be controlled in accordance with the capacity of the fluid machine varying by application of the displacement type fluid machine. This brings about an effect that the performance of the compressor lowering due to an excessive feed of the oil can be prevented.

Figure 15A:
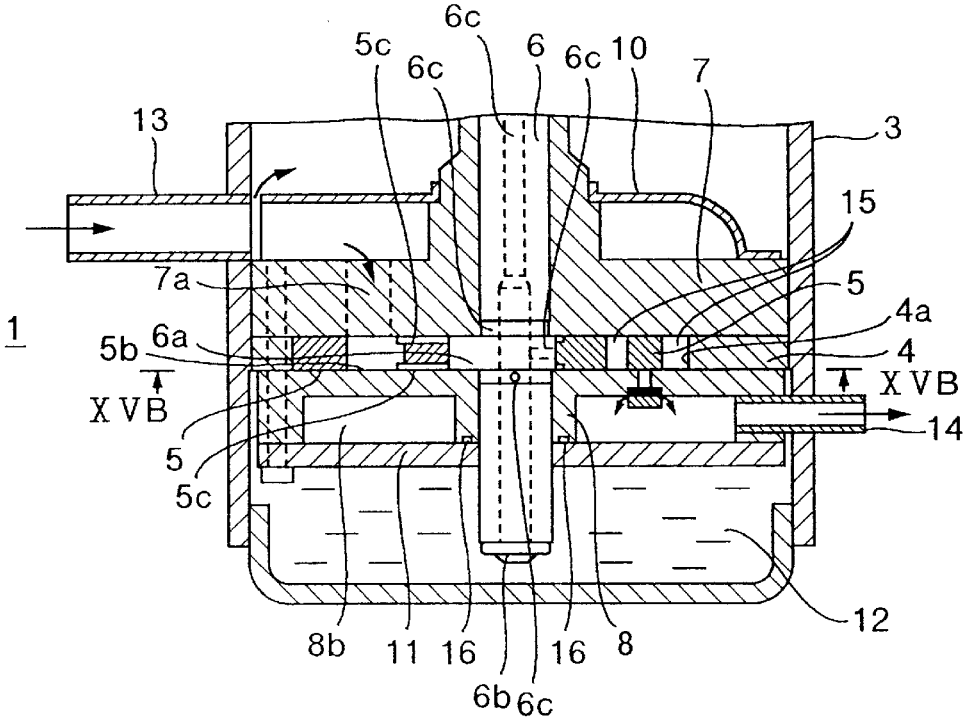
FIGS. 15A and 15B are a vertical sectional view and a plan view of a compression element of a hermetic type compressor wherein a displacement type fluid machine according to another embodiment of the present invention is applied to the compressor.

Next, an oil-feeding system according to the second embodiment of the present invention will be described with reference to FIGS. 15A to 18F. FIG. 15A is a vertical sectional view of a hermetic type compressor wherein a displacement type fluid machine according to the present invention is used as the compressor (corresponding to a sectional view taken along line XVA—XVA in FIG. 15B).

Figure 15B:
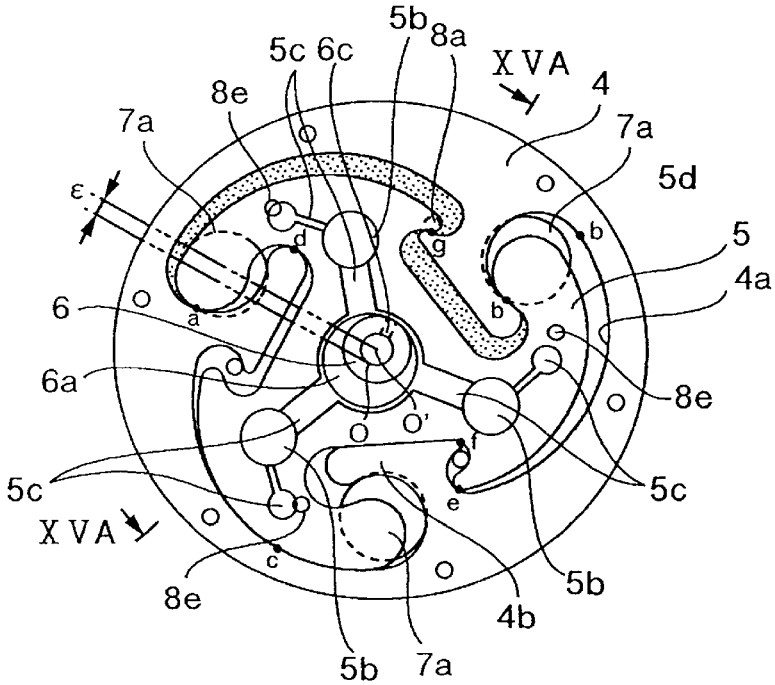
Figure 16A:
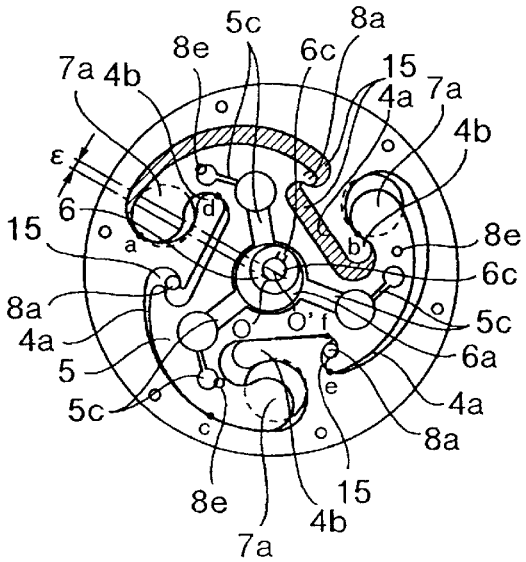
FIGS. 16A to 16D are views for illustrating the principle of operation of the displacement type fluid machine according to another embodiment of the present invention.
Figure 16B:
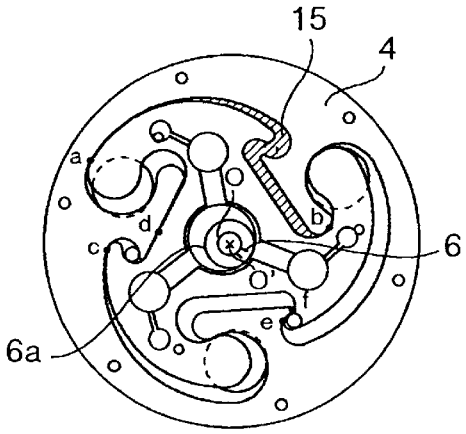
Figure 16C:
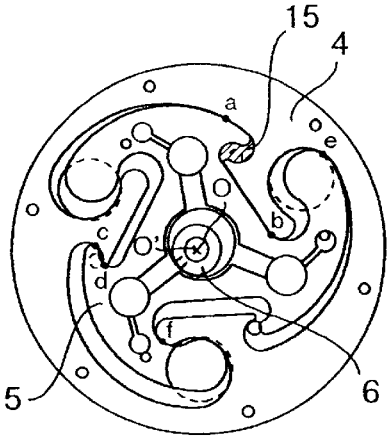
Figure 16D:
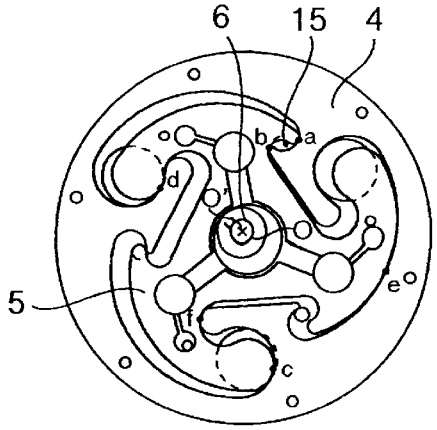
Figure 17A:
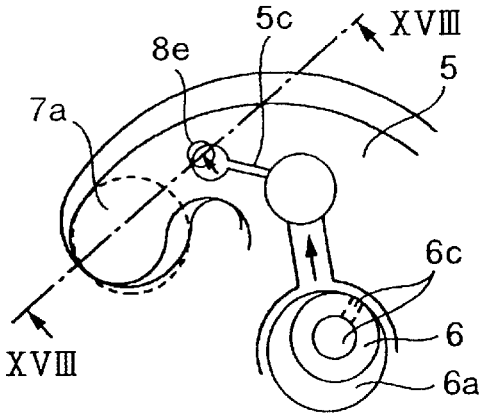
FIGS. 17A to 17F are enlarged views of the suction port part of FIG. 15(*b*)
Figure 17B:
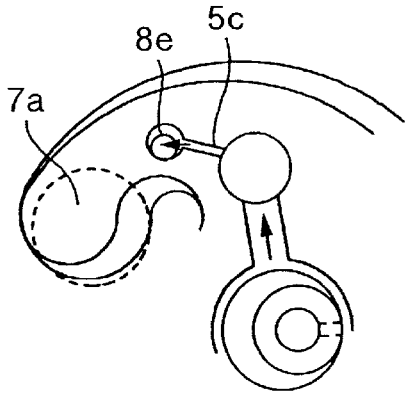
Figure 17C:
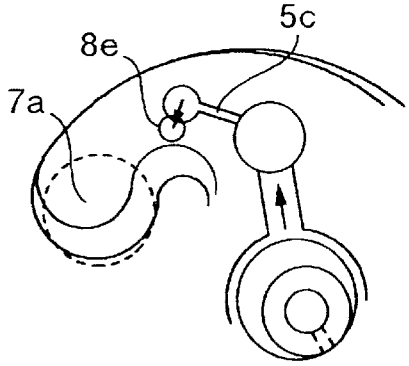
Figure 17D:
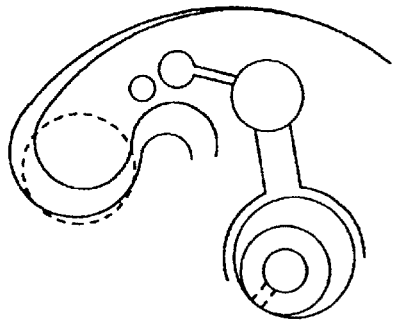
Figure 17E:
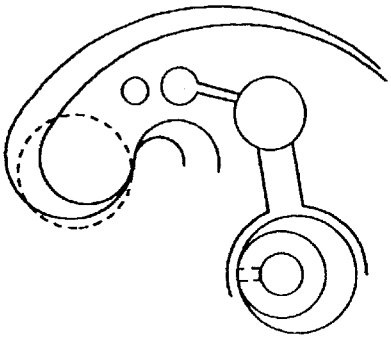
Figure 17F:
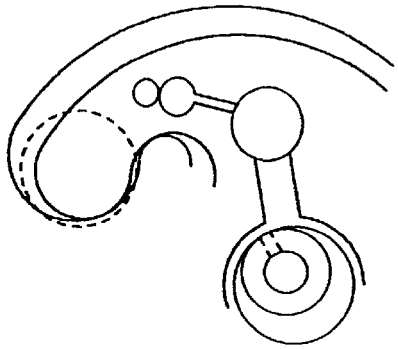
Figure 18A:
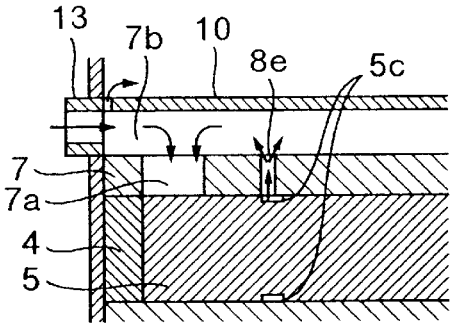
FIGS. 18A to 18F are sectional views taken along line XVIII—XVIII in FIGS. 17.
Figure 18B:
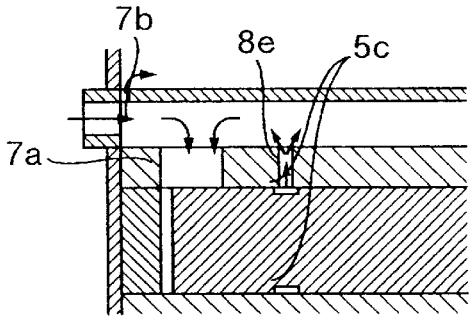
Figure 18C:
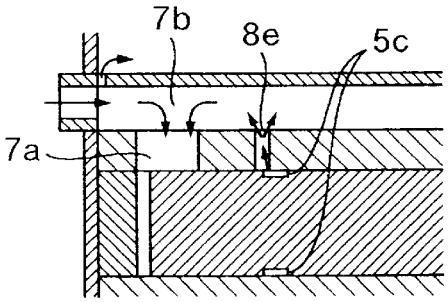
Figure 18D:
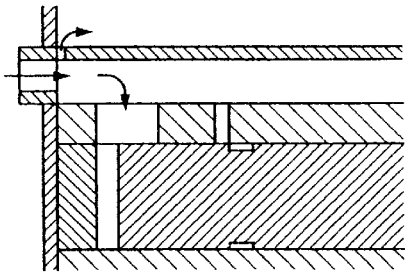
Figure 18E:
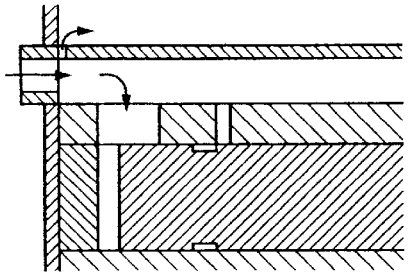
Figure 18F:
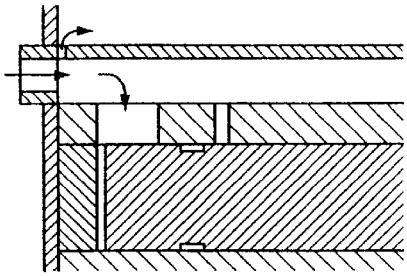

FIG. 15B is a plan view along line XVB—XVB in FIG. 15A. FIGS. 16A to 16D are views for illustrating the principle of operations of a displacement type compression element. FIGS. 17 are enlarged views near the suction port 7*a* of FIG. 15B, showing oil-feeding states at every 60° in one rotation of the rotating shaft 6 from suction completion (compression start). FIGS. 18A to 18F are sectional views taken along line XVIII—XVIII in FIGS. 17A. The base construction of the displacement type fluid machine of this embodiment is the same as that of the first embodiment. The parts of this embodiment corresponding to those of the first embodiment are denoted by the same references as those of the first embodiment, and operate in the same manner as those of the first embodiment, respectively. For this reason, the description on the operations of compression and the oil-feeding system for sliding portions of bearing are omitted here.

The displacer 5 is provided in each end surface with an oil-feeding groove 5*c*. This oil-feeding groove 5*c* is always fed with a lubricating oil 12 like the first embodiment. In gyration of the displacer 5, the oil-feeding groove 5*c* communicates with a communication hole 8*e* formed in the main bearing member 7. The communication hole 8*e* is located so as to be always opposed to the end surface of the displacer 5 at any rotational position of the rotating shaft 6, and so it never open to a working chamber 15. As shown by arrows in FIGS. 17A to 17F and 18A to 18F, while the rotating shaft 6 rotates from 0° to 120°, the lubricating oil 12 is driven from the oil-feeding groove 5*c* formed in the end surface of the displacer 5, to the suction chamber 7*b* through the communication hole 8*e*. Such an operation is carried out once in each wrap portion for 360° of the rotational angle of the rotating shaft 6. By repeating the operation, the quantity of the circulating oil in the working fluid in the compression element can be increased to be more than the quantity of the circulating oil in the working fluid in the refrigeration cycle. By this manner, because the lubricating oil 12 is surely fed to the contact portions of the displacer 5 and cylinder 4 in a state of being mixed in the working fluid (a mist state), the lubricating condition is improved and so it becomes possible to provide a displacement type fluid machine with a considerably improved reliability. If a large quantity of lubricating oil is fed, it is possible to feed a fixed quantity of lubricating oil to the suction chamber 7*b* by the manner that the oil-feeding groove 8*c* is provided between the communication hole 8*e* and oil-feeding groove 5*c*, and a concave portion for making the oil-feeding groove 8*c* communicate with the communication hole 8*e* is provided on the displacer 5 side, like the first embodiment.

In the above first and second embodiment, there has been described a hermetic type compressor (low-pressure chamber) wherein the pressure in the hermetic container 3 is at a low pressure (suction pressure). Such a construction brings about the following advantages.

(1) Because the motor element 2 is less heated by the compressed working gas at a high temperature and cooled by the suction gas, the temperatures of the stator 2*a* and rotor 2*b* fall and so the motor efficiency is improved to improve the performance.

(2) In case of a working fluid soluble in a lubricating oil 12 such as chlorofluorocarbon, the rate of the dissolved working gas in the lubricating oil 12 is less because of a low pressure. The oil is hard to bubble in a bearing portion or the like, and so the reliability is improved.

(3) It is possible to lower the capacity to pressure of the hermetic container 3, and so the container can be made slim and light.

Figure 19A:
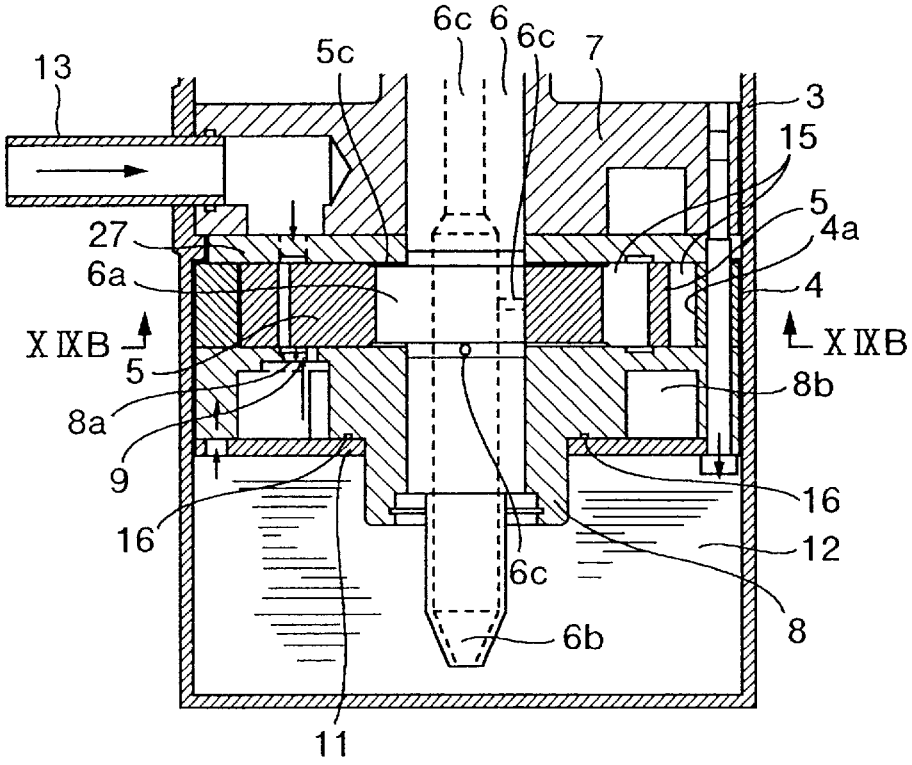
FIGS. 19A and 19B are a vertical sectional view and a plan view of a compression element of a hermetic type compressor wherein a displacement type fluid machine according to another embodiment of the present invention is applied to the compressor (quadruple wrap)
Figure 19B:
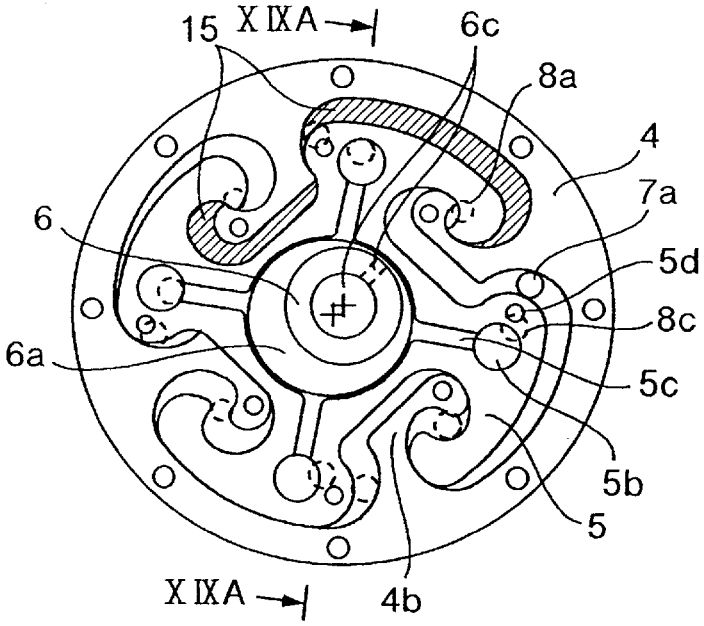

Next, the third embodiment wherein the present invention is applied to a case of quadruple wrap, will be described with reference to FIGS. 19A to 20B. FIG. 19A is a vertical sectional view of a hermetic type compressor wherein a displacement type fluid machine of a quadruple wrap according to the present invention is used as the compressor (corresponding to a sectional view taken along line XIXA—XIXA in FIG. 19B). FIG. 19B is a plan view along line XIXB—XIXB in FIG. 19A. This embodiment has the same construction and the same operations as the above-described embodiments of the triple wrap, so the description of the detail of this embodiment is omitted here.

A partition 27 is disposed between the cylinder 4 and main bearing member 7. The suction port 7*a* and an oil-feeding groove 27*a* are formed in the partition 27. By increasing the number of wrap portions in this manner, the number of working chambers 15 disposed evenly around the rotating shaft 6 increases. As a result, the dynamic balance is more improved, the rotating moment acting on the displacer 5 is reduced, and the contact load between the cylinder 4 and displacer 5 is also reduced. It is possible to improve the performance by reducing the mechanical friction loss, and to improve the reliability of the contact portions. Besides, because the number of effective working chambers increases, it is possible to decrease the heights (thickness) of the cylinder 4 and displacer 5. It is thus possible to downsize the displacement type compression element 1.

Figure 20A:
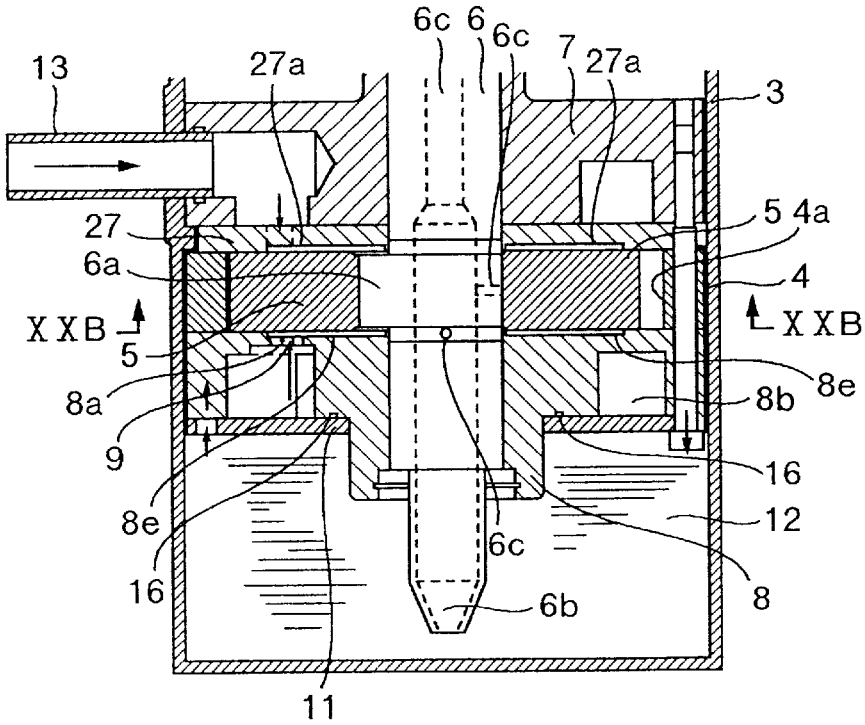
FIGS. 20A and 20B are a vertical sectional view and a plan view of a compression element of a hermetic type compressor wherein a displacement type fluid machine according to another embodiment of the present invention is applied to the compressor (quadruple wrap).
Figure 20B:
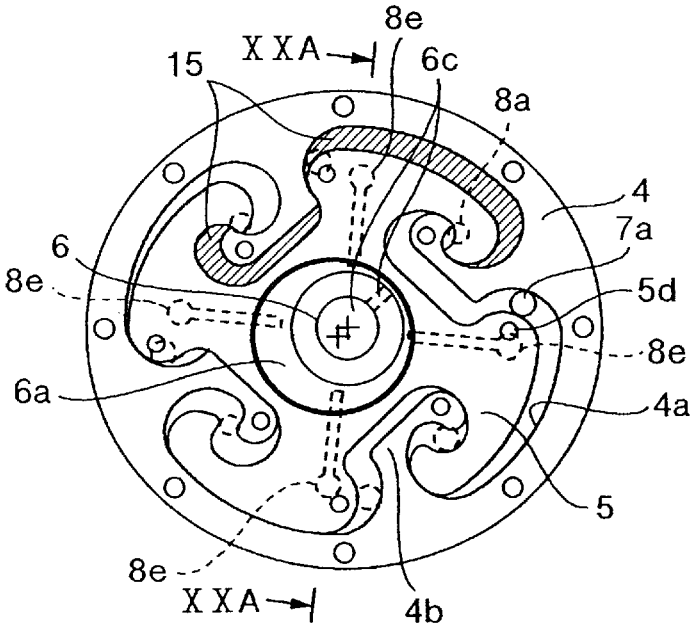

FIG. 20A is a vertical sectional view of a hermetic type compressor wherein a displacement type fluid machine of a quadruple wrap according to the present invention is used as the compressor (corresponding to a sectional view taken along line XXA—XXA in FIG. 20B). FIG. 20B is a plan view along line XXB—XXB in FIG. 20A. The base construction of the displacement type fluid machine of this embodiment is the same as that of the above-described embodiments of the triple wrap. The parts of this embodiment corresponding to those of the above-described embodiments are denoted by the same references as those of the above-described embodiments, and operate in the same manner as those of the above-described embodiments, respectively. For this reason, the description on the operations of compression and the oil-feeding system for sliding portions of bearing are omitted here.

As shown in FIG. 20B, oil-feeding grooves 27*a* and 8*e* always fed with a lubricating oil are formed in a partition 27 disposed on the end surface of the main bearing member 7, and the end surface of the auxiliary bearing member 8, respectively. The lubricating oil 12 can be fed to the vicinity of the suction port 7*a* by the same principle of operation as that described above. The oil-feeding grooves 27*a* and 8*e* are formed at the same positions as the center O' of the cylinder 4 is the origin, always located over the end surface of the displacer 5, and never open to a working chamber 15. The oil-feeding grooves 5*c*, 7*c*, 8*c*, 27*a* and 8*e*, oil-receiving groove 8*d* and oil-feeding pocket 5*d* described in other embodiments of the present invention may have any shapes but limitation by processing or the like. In these oil-feeding systems of the present invention, the number of wrap portions is not limited.

In the embodiment shown in FIGS. 19A to 20B, a hermetic type compressor (high-pressure chamber type) is described wherein the suction pipe 13 is made to communicate with the suction space of the compression mechanism part, the refrigerant from the discharge port 8*a* is discharged into the hermetic container, and the interior of the hermetic container 3 is at a high pressure (discharge pressure) because of the construction that the refrigerant is fed from the discharge pipe 14 through the interior of the hermetic container, for example, into the refrigeration cycle. By this construction, the lubricating oil 12 is at a high pressure and so becomes easy to feed to each sliding portion of the displacement type compression element 1. It is thus possible to improve the sealing performance of working chambers 15 and the lubricating performance of each sliding portion.

Like the above-described embodiments of low-pressure chamber, because the sliding surfaces (near the suction port 7*a*) of the outer wall surface of the tip portion on the suction port 7*a* side of the displacer 5 and the inner wall surface of the cylinder 4 are portions easy to slide in contact, it is necessary to feed the lubricating oil 12 to those portions.

For lubricating sliding surfaces (near the suction port 7*a*) of the outer wall surface of the tip portion on the suction port 7*a* side of the displacer 5 and the inner wall surface of the cylinder 4, it is thinkable that the oil-feeding groove 5*c* is extended beyond the oil-feeding pocket 5*d* to the vicinity of the tip of the displacer 5 so as always to feed the oil. But this measure meets the following problems. This chamber is a high-pressure chamber type of discharge pressure, and the lubricating oil 12 is fed by a difference pressure. Hence, if the oil-feeding groove 5*c* is extended beyond the oil-feeding pocket Sd to the tip portion of the displacer 5 so as to communicate with the suction port, the lubricating oil 12 is continuously fed to the tip portion of the displacer 5 by the pressure corresponding to the difference between the discharge pressure and suction pressure. This causes an excessive feed of the oil. The rate of the volume of the lubricating oil in the working chamber then increases. Because of the increase of the rate of the volume, the quantity of the refrigerant fed from the suction port decreases accordingly. This causes a problem of lowering the volumetric efficiency of the compressor. Besides, because of the high-pressure chamber type, a large quantity of refrigerant fuses in the lubricating oil 12 stored in the reservoir, and it comes out from the lubricating oil with bubbling the lubricating oil at the moment that the lubricating oil enters the suction port. This part of coolant having come out from the lubricating oil joins with the part of coolant having been sucked from the exterior, and compressed to discharge through the discharge port. But all of the refrigerant does not return to the refrigeration cycle through the discharge pipe 14. The pressure in the high-pressure chamber decreases by the quantity of the refrigerant discharged to the discharge port by differential pressure oil-feeding. The discharge pressure is maintained by compensating by the refrigerant discharged from the discharge port by the quantity corresponding to the above quantity discharged to the discharge port. That is, there is formed a close loop that the same quantity of refrigerant as the refrigerant having fused in the lubricating oil and then discharged into the suction port through the oil-feeding system, again fuses in the lubricating oil. Because the quantity of refrigerant circulating in the close loop does not perform the work as a heat pump by entering the refrigeration cycle, the compressor performs an excessive compression work by that quantity of refrigerant so the performance of the compressor lowers.

On the other hand, in case that the oil-feeding groove 5*c* is formed to the front of the oil-feeding pocket 5*d* near the tip of the displacer 5, and the lubricating oil 12 is always stored therein (lubrication between the end plate and displacer is possible), because the lubricating oil 12 is not continuously fed to the region between the outer wall surface of the tip portion on the suction port 7*a* side of the displacer 5 and the inner wall surface of the cylinder 4 unlike the above case, the above problem of an excessive feed is solved. But, because of the high-pressure chamber, the driving force for feeding the lubricating oil 12 to the oil-feeding groove 5*c* is caused by the difference in pressure due to differential pressure oil-feeding. The lubricating oil 12 oozes out from the oil-feeding groove 5*c* formed in the displacer 5 to a working chamber at a lower pressure than the discharge pressure through a gap formed between the displacer 5 and end plate. But the oil amount is insufficient by the extent of the oozing quantity. When the gap is enlarged to increase the oil-feeding quantity, though the amount of lubricating oil fed to the working chamber is surely increased, there is no warranty for feeding the lubricating oil to the above-described portion near the suction port most desired to feed the lubricating oil. Besides, because the oil leaks out in the working chamber in the course of compression, the internal pressure of the working chamber increases to increase the works of the driving part (motor) for generating a gyration. As a result, there arises a problem that the input of the motor increases.

For solving the above problems, this embodiment employs such an intermittent oil feed as described above. The intermittent oil feed is the same as that of the above embodiments of triple wrap.

As described above, as a displacement type fluid machine provided with an oil-feeding system according to the present invention, either of the low-pressure type and high-pressure type can be selected in accordance with the specification of a machine, application, manufacturing facilities or the like.

The present invention is applicable to an airconditioning system of heat pump cycle capable of cooling and heating, wherein a displacement type fluid machine according to the present invention is used as a compressor. In that case, the displacement type compressor operates based on the principle of operation illustrated in FIGS. 2. By starting the compressor, compression operations for a working fluid (such as hydrochlorofluorocarbon HCFC 22 or hydrofluorocarbon, R-407C and R-410A) are carried out between a cylinder 4 and a displacer 5.

Besides, a displacement type fluid machine according to the present invention is also applicable to a refrigeration system such as a refrigerator. Further, although compressors are described as examples of displacement type fluid machine in the above embodiments, the present invention is also applicable to expanders and power machinery other than those. Further, in the above embodiments, one (cylinder side) is stationary and the other (displacer side) revolves with a substantially constant radius of gyration without rotating on its own axis. But the present invention is also applicable to a displacement type fluid machine of both rotation type in a movement form relatively equal to the above movement.

What is claimed is:

1. A displacement type fluid machine comprising a displacer and a cylinder disposed between end plates such that a space is formed by an inner wall surface of said cylinder and an outer wall surface of said displacer when a center of said cylinder is located on a center of said displacer, and a plurality of working chambers is formed when a positional relationship between said displacer and said cylinder is directed to a gyration position, a suction port for introducing a fluid to one of said working chambers, a discharge port for discharging said fluid from said one of said working chambers, a groove formed in a surface of said displacer opposite to one of said end plates so as to extend from a central portion of said displacer toward a tip portion on the suction port side to a position for communicating with said suction port by a gyration movement of said displacer, and means for feeding a lubricating oil to said groove from said central portion of said displacer.

2. A displacement type fluid machine comprising a cylinder disposed between end plates and having an inner wall whose contour in a cross section is formed by a continuous curve, a displacer disposed between said end plates and having an outer wall opposite to said inner wall of said cylinder for forming a plurality of working chambers by said outer wall in cooperation with said inner wall when a positional relationship between said displacer and said cylinder is directed to a gyration position, a suction port for introducing a fluid to one of said working chambers, a discharge port for discharging said fluid from said one of said working chambers, said suction port comprising a through hole formed in one of said end plates, and an oil-feeding system for feeding a lubricating oil to said suction port from the opposite surface side of said one of said end plates, in which said suction port is formed, to a surface facing said displacer.

* * * * *